US010650654B2

(12) United States Patent
Batra et al.

(10) Patent No.: US 10,650,654 B2
(45) **Date of Patent: *May 12, 2020**

(54) SYSTEM AND METHOD FOR MONITORING AND TRACKING ITEMS

(71) Applicant: SekureTrak, Inc., Chicago, IL (US)

(72) Inventors: Parminder K. Batra, Chicago, IL (US); Arun Sobti, South Barrington, IL (US); Rien Heald, Aurora, IL (US)

(73) Assignee: SekureTrak, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/000,386

(22) Filed: Jun. 5, 2018

(65) Prior Publication Data

US 2018/0286205 A1 Oct. 4, 2018

Related U.S. Application Data

(63) Continuation of application No. 14/789,411, filed on Jul. 1, 2015.

(60) Provisional application No. 62/019,954, filed on Jul. 2, 2014.

(51) Int. Cl.
*G08B 13/24* (2006.01)
*G08B 25/10* (2006.01)

(52) U.S. Cl.
CPC ..... *G08B 13/2462* (2013.01); *G08B 25/10* (2013.01)

(58) Field of Classification Search
CPC ..... G08B 13/2462; G08B 25/10
See application file for complete search history.

(56) References Cited

U.S. PATENT DOCUMENTS 7,825,794 B2 * 11/2010 Janetis ..... G01S 5/0027 340/539.13
8,154,401 B1 * 4/2012 Bertagna ..... H04W 4/021 340/539.13
8,836,501 B2 * 9/2014 Song ..... G08B 21/023 340/539.1
9,494,674 B2 * 11/2016 Messier ..... G01S 19/48
2004/0150521 A1 * 8/2004 Stilp ..... G07C 9/00103 340/545.1
2008/0143604 A1 * 6/2008 Mock ..... G01S 5/0205 342/450
2008/0171561 A1 * 7/2008 Irony ..... H04W 76/15 455/466
2011/0234399 A1 * 9/2011 Yan ..... G08B 21/24 340/539.32

(Continued)

*Primary Examiner* — Quan-Zhen Wang
*Assistant Examiner* — Rajsheed O Black-Childress
(74) *Attorney, Agent, or Firm* — Quarles & Brady LLP

(57) ABSTRACT

A method, system, and non-transitory computer-readable medium are disclosed. The method includes determining, by a server, an inventory of tags in communication with a gateway using a first wireless communication mode, and enabling, in response to a first triggering event recognized by a tag, a second wireless communication mode. The method also includes enabling, in response to a second triggering event recognized by the tag, a third wireless communication mode and a location detection capability of the tag. The method further includes determining, by the tag, a geographic location of the tag using a location detection capability, and transmitting, using the third wireless communication mode, to a server the geographic location of the tag.

32 Claims, 8 Drawing Sheets

(56) References Cited

U.S. PATENT DOCUMENTS

| | | | | |
|---|---|---|---|---|
| 2011/0248853 | A1* | 10/2011 | Roper | G08B 21/0286 340/573.4 |
| 2014/0361902 | A1* | 12/2014 | Carlsson | G08B 21/023 340/686.6 |
| 2015/0154847 | A1* | 6/2015 | Oliver | H04W 4/80 340/686.6 |

* cited by examiner

SYSTEM AND METHOD FOR MONITORING AND TRACKING ITEMS

CROSS-REFERENCE TO RELATED APPLICATIONS

The present application is a continuation of U.S. patent application Ser. No. 14/789,411, filed Jul. 1, 2015, and issued Jun. 5, 2018, as U.S. Pat. No. 9,990,823, which claims priority to U.S. Provisional Patent Application No. 62/019,954, filed on Jul. 2, 2014, each of which is incorporated herein by reference in its entirety.

FIELD

The present disclosure relates generally to tracking items within an area. More particularly, the present disclosure relates to tags fixed to the items that can communicate with a network of wireless communication devices and can transmit the tags' locations when outside of the network.

BACKGROUND

The following description is provided to assist the understanding of the reader. None of the information provided or references cited is admitted to be prior art. Valuable items are often the targets of theft. Various techniques are used to prevent theft from occurring such as using locks, alarms, fences, safes, etc. Such techniques can be inefficient and cumbersome. Despite such security techniques, items are still lost or stolen. Once items are stolen, they can be difficult to retrieve.

SUMMARY

An illustrative method includes determining, by a tag, that a gateway is not within communication range of the tag using a first wireless communication mode and enabling, in response to the tag determining that the gateway is not within communication range of the tag, a second wireless communication mode. The method also includes determining, by the tag, that a mobile device is not within communication range of the tag using the second wireless communication mode and enabling, in response to the tag determining that the mobile device is not within communication range of the tag, a third wireless communication mode and a location detection capability. The method further includes determining, by the tag, a geographic location of the tag using the location detection capability and transmitting, using the third wireless communication mode, to a server the geographic location of the tag.

An illustrative device includes memory, a first wireless transceiver, a second wireless transceiver, a third wireless transceiver, a location detector and a processor. The memory is configured to store a list of associated gateways and a list of associated mobile devices. The first wireless transceiver is configured to communicate using a first wireless communication mode. The second wireless transceiver is configured to communicate using a second wireless communication mode. The third wireless transceiver configured to communicate using a third wireless communication mode. The location detector is configured to determine a geographic location of the device. The processor is operatively coupled to the memory, the first wireless transceiver, the second wireless transceiver, the third wireless transceiver, and the location detector. The processor is configured to determine that a gateway is not within communication range of the device using the first wireless transceiver and enable, in response to the processor determining that the gateway is not within communication range of the device, the second wireless transceiver. The gateway is in the list of associated gateways. The processor is also configured to determine that a mobile device is not within communication range of the device using the second wireless transceiver and enable, in response to the processor determining that the mobile device is not within communication range of the device, the third wireless transceiver and the location detector. The mobile device is in the list of associated mobile devices. The processor is further configured to receive, from the location detector, the geographic location of the device and transmit, using the third wireless transceiver, to a server the geographic location of the device.

An illustrative non-transitory computer-readable medium has computer-readable instructions stored thereon that, upon execution by a processor, cause a device to perform operations. The instructions comprise instructions to determine that a gateway is not within communication range of the device using a first wireless communication mode and instructions to enable, in response to the device determining that the gateway is not within communication range of the device, a second wireless communication mode. The instructions also include instructions to determine that a mobile device is not within communication range of the device using the second wireless communication mode and instructions to enable, in response to the device determining that the mobile device is not within communication range of the device, a third wireless communication mode and a location detection capability. The instructions further include instructions to determine a geographic location of the device using the location detection capability and instructions to transmit, using the third wireless communication mode, to a server the geographic location of the device.

The foregoing summary is illustrative only and is not intended to be in any way limiting. In addition to the illustrative aspects, embodiments, and features described above, further aspects, embodiments, and features will become apparent by reference to the following drawings and the detailed description.

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Detailed embodiments of the invention are disclosed herein. However, the disclosed embodiments are merely exemplary and the concepts disclosed herein may be embodied in various and alternative forms. The figures are not necessarily to scale, and some features may be exaggerated or minimized to show details of particular components. Therefore, specific structural and functional details disclosed herein are not to be interpreted as limiting, but merely as representative of the disclosed particular embodiments with the understanding that these may vary according to other illustrative embodiments.

Valuable items can be stolen or go missing despite taking protective measures. For example, equipment such as lawn mowers, skid-steer loaders, cranes, all-terrain vehicles, utility vehicles, etc. can be stolen from construction sites, storage locations, trailers, the field in which they are used, etc. In another example, valuable items can be stored indoors, such as in a home. In many cases, the valuable items are mobile or movable and should not be permanently fixed to the earth or a structure. For example, a lawn mower is valuable because it is mobile. Although the lawnmower would be secure if welded to a pad permanently fixed to the earth, the lawnmower would not be practicably useable. In some instances, it is more convenient that items are mobile. For instance, although jewelry can be stored in a steel safe that is securely bolted to the foundation of a house, such safes can be aesthetically displeasing, located in inconvenient locations, have difficult locking mechanisms, etc. Various aspects of the present disclosure allow items to be tracked even when the items have left the premises or possession of authorized users. Thus, such items can remain mobile and/or convenient but can still provide protection against theft (e.g., by locating the items after they have been stolen or gone missing and returning the items to the owner).

Figure 1:
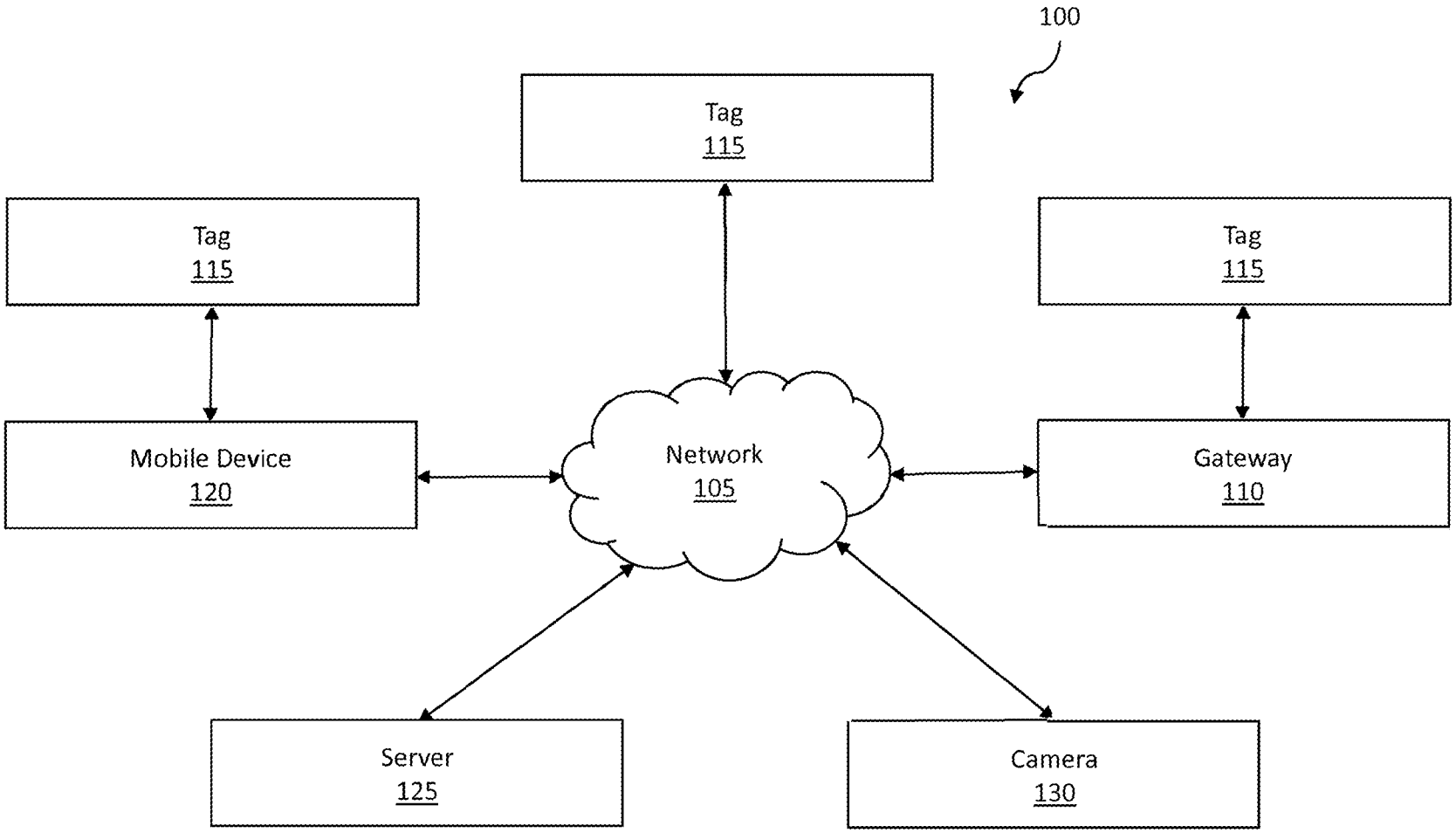
FIG. 1 is a block diagram of an item management system in accordance with an illustrative embodiment.

FIG. 1 is a block diagram of an item management system in accordance with an illustrative embodiment. In alternative embodiments, additional, fewer, and/or different elements can be used. The item management system 100 includes a network 105, one or more gateways 110, one or more tags 115, a server 125, and one or more cameras 130.

In an illustrative embodiment, the item management system 100 can be configured to transmit to the server 125 the location of the tags 115. A tag 115 can communicate with a gateway 110 via a first wireless communication method (e.g., via a wireless local area network (WiFi)). When the tag 115 is recognized by the gateway 110, the gateway 110 can indicate to the server 125 the location of the tag 115 (e.g., within a communication range of the gateway 110). The tag 115 can also recognize that the tag 115 is in communication with the gateway 110. If the tag 115 is not in communication with the gateway 110 (or another authorized gateway 110), the tag 115 can initialize a second wireless communication method (e.g., Bluetooth®) and can communicate with the mobile device 120. The mobile device 120 can be, for example, a smartphone. The mobile device 120 can communicate to the server 125 the location of the tag 115. For example, the mobile device 120 can use a location detection device (e.g., GPS) to determine the location of the mobile device 120 and, therefore, the location of the tag 115. The tag 115 can also recognize that the tag 115 is in communication with the mobile device 120. If the tag 115 is not in communication with either the gateway 110 or the mobile device 120, the tag 115 can initialize a third wireless communication method (e.g., a cellular network) and a location detection device (e.g., GPS). In some embodiments, the location detection device of the tag 115 is activated in response to receiving a signal from a gateway 110 located at the entrance and/or exit of an area or building. The tag 115 can communicate to the server 125 the location of the tag 115. The above described embodiment is merely one example illustrating various aspects of the present disclosure. Alternatives and additional embodiments will be discussed in greater detail below.

The network 105 can be any suitable communications network. The network 105 can include wired and/or wireless communications. The network 105 can include a local area network (LAN), a wide area network (WAN), a private area network (PAN), a mobile communications network (e.g., a cellular network), the Internet, etc. In an illustrative embodiment, the network 105 can include a LAN that is connected to the Internet and a mobile communications network that is connected to the Internet. The network 105 can use any suitable communications protocols.

The tags 115 can be fixed to items that are to be tracked. That is, in some embodiments, by affixing tags 115 to items normally located within authorized areas of the item tracking system 100, the location of the items can be monitored to determine whether the item has been removed from the authorized area and/or possession of an authorized user, as explained in greater detail below. The tags 115 can be configured to communicate to the gateways 110, the mobile devices 120, and the network 105 to transmit information to the server 125. For example, information indicating the location of a tag 115 can be transmitted to the server 125.

The tags 115 can be any suitable size. Some tags 115 can be larger than others to accommodate additional features and/or a larger battery capacity. Different tags 115 can also be configured to provide different alert configurations, depending upon the application. In some embodiments, tags 115 include a Bluetooth® chip, a processor, an accelerometer, a battery, an antenna, a humidity/moisture sensor, and a GPS chip. The tags 115 can be configured to communicate with gateways 110 and mobile devices 120 to disclose the location of the tags 115 to the server 125 at pre-determined intervals, on demand, or when the signal strength of the signal of the tag 115 received by a gateway 110 or a mobile device 120 is below a threshold. In some embodiments, an accelerometer can be configured to trigger the tag 115 to send an alert when an item is moved a certain distance (e.g., a few inches, a few feet, etc.), when the tag 115 is removed from a particular zone, when the tag 115 is removed from a specified location, etc. Similarly, in some embodiments, temperature, moisture, and/or other sensors can be used to initialize alerts. In some embodiments, tags 115 can include an alarming mechanism that can be triggered when the tag 115 determines that it is not in an authorized area. The alarming mechanism can be any suitable alarm such as an audio alarm (e.g., a siren, a voice, etc.), a visual alarm (e.g., flashing lights), a vibratory alarm, etc.

In some embodiments, the gateways 110 are fixed to a location. For example, gateways 110 can be fixed within or outside a building such as a warehouse, a depot, a manufacturing plant, a workplace, an office, etc. In some embodiments, gateways 110 are fixed to mobile locations such as a truck, a recreational vehicle, an airplane, a mobile workstation, a toolbox, etc. The gateways 110 can be any suitable device configured to communicate with the one or more tags 115 via wireless communications. For example, IEEE® standard 802.11 wireless communications can be used. In some embodiments, the gateways 110 are wireless routers. When a tag 115 is in communication range of a gateway 110, the gateway 110 can communicate to the server 125 via network 105 that the gateway 110 is in communication with the tag 115. An indication that the gateway 110 is within communication range of the tag 115 can be used to determine that the tag 115 is within an authorized zone. That is, the gateways 110 that are used within system 100 can be authorized gateways 110 associated with the system 100. The tags 115 and the gateways 110 can be configured such that only authorized tags 115 can communicate with authorized gateways 110.

In some embodiments, gateways 110 can include a backup battery to supply power in case of a line power failure. Also, in some embodiments, gateways 110 can be configured to communicate information via a cellular network. In such embodiments, if a network or Internet connection used by the gateways 110 to communicate with the server 125 fails, the gateways 110 can communicate with the server 125 via the cellular network.

In some embodiments, gateways 110 can be configured to receive a short-range wireless communication signal (e.g., a Bluetooth® signal) from the tags 115 and convert the signal into a mid-range wireless communication format (e.g., WiFi) or a wired communication format (e.g., IEEE® standard 802.11). The gateways 110 can transmit the information received from the tags 115 to the server 125. In such embodiments, the tags 115 may not have the mid-range wireless communication format. That is, the tags 115 can be configured to communicate information to the server 125 through short-range wireless signals (e.g., Bluetooth® signals via gateways 110 and/or mobile devices 120) or long-range wireless signals (e.g., via a cellular network).

In some embodiments, the gateways 110 have the ability to store information including sweep logs, alerts history, alert resolutions, and device information. Such information can be stored for a period of up to a month even if line power has failed. When connected through WiFi (or any other suitable communication method) to the server 125, the gateway 110 communicates the stored information to the server 125. A user or user-authorized individuals can access the information stored on the server 125 and/or the gateway 110. In some embodiments, the gateway 110 is equipped with a back-up battery and cellular technology to communicate with the server 125 in the case of power outage and/or WiFi failures. In some embodiments, the gateway 110 may be plugged into an auxiliary port of the premises' security system to allow for a burglar alarm to be activated, as well as contacting the appropriate authorities in case of theft of one or more items with a tag 115.

In some embodiments, the mobile devices 120 are devices configured to receive a wireless signal from one or more tags 115 and transmit a signal to the server 125 indicating that the one or more tags 115 are in an authorized area. Some examples of mobile devices 120 include cell phones, smartphones, tablets, laptops, etc. In some embodiments, the mobile devices 120 use a short-range wireless communication method, such as Bluetooth®, to communicate with the tags 115. In some embodiments, the mobile devices 120 use WiFi to communicate with the tags 115. When the tag 115 is within communication range of a mobile device 120, the tag 115 can communicate with the mobile device 120 (discussed in greater detail below). The mobile device 120 can use any suitable method to determine the location of the mobile device 120. For instance, the mobile device 120 can use a WiFi positioning system (e.g., Combain Positioning Services™ or any other suitable system for determining position via WiFi), a GPS sensor, cellular network triangulation, etc. The mobile device 120 can then communicate to the server 125 the identification information of the tag 115, identification information of the mobile device 120, the location of the mobile device 120, and any other suitable information. Additional information can include a remaining battery life of the tag 115, a signal strength received by the mobile device 120 from the tag 115, a remaining battery life of the mobile device 120, etc.

When a tag 115 is not in communication range of an authorized gateway 110 or mobile device 120, the tag 115 can activate a location sensor and a long-range wireless communications transceiver. In some embodiments, the long-range wireless communications is a cellular network. The cellular network can be used in any suitable way to transmit information from the tag 115 to the server 125 such as via an audio phone call, a Short Message Service (SMS) text message, or a data transmission (e.g., email, third generation (3G) data communications, fourth generation (4G) data communications, Long-Term Evolution (LTE) data communications, etc.). In some embodiments, the tag 115 can communicate with the server 125 via any available method, such as via a wireless router connected to the Internet. In such embodiments, the wireless router need not be an authorized gateway 110 and can be any wireless router that allows the tag 115 access to the Internet or otherwise communicate with the server 125.

The server 125 can be configured to communicate with the gateways 110, the mobile devices 120, and the tags 115 to monitor the locations of the tags 115. The server 125 can be any suitable computing device. In some embodiments, the server 125 can include a plurality of computing devices. In some embodiments, the server 125 comprises cloud computing devices. In some embodiments, the server 125 is configured to maintain a list of tags 115 and the location of each tag 115, if known. In some embodiments, each event is stored in on the server 125, which can be a secure server using cloud computing. In other embodiments, the information on the gateways 110 and/or mobile devices 125 is accessible through authentication and query by a remote access computing device of the user. A local server can be connected to the Internet and can have the ability to store information including sweep logs, alerts history, resolutions, and device information for a period of up to a month even without line power. Resolutions can be how conflicts are resolved and/or what the resolution of the conflict was. For example, if multiple gateways 110 indicate that they are communicating with a tag 115, the resolutions can include which gateway 110 was determined to be the closest to the tag 115 (e.g., via signal strength). When connected through WiFi (or any other suitable connection) to the server 125 (or the local server), the gateways 110 can communicate the stored information to the server 125. The server 125 can allow access to the information by the user or user-authorized individuals.

In some embodiments, the gateways 110 and mobile devices 120 communicate with the tags 115 and collect information regarding the presence and location of the tags 155 and communicate such information to a local server. In an illustrative embodiment, the local server can be connected to some or all of the gateways 110 and mobile devices 120 via a LAN. The information transmitted to the local server can be be stored on the local server until the information can be transmitted to the server 125. Thus, in the event of a communications failure between the LAN (and devices connected to the LAN) and the server 125 (which can be remotely located), the information is not lost. In an illustrative embodiment, the information on the local server is accessible through authorization by a user's remote access device, which can be a computer, smartphone, tablet, etc.

As mentioned above, tags 115 can be used to track the location of items. In some embodiments, a camera 130 can be used in item management system 100. In some embodiments, the camera 130 is configured to capture still images. In alternative embodiments, the camera 130 is configured to capture video images. In such embodiments, if it is determined (e.g., via the server 125) that a tag 115 is in proximity to a camera 130, the camera 130 can capture an image. In some embodiments, multiple cameras 130 can be used. For example, if it is determined that a tag 115 is near an entrance/exit of a premises, one or more cameras 130 can be used to capture an image of the entrance/exit. In such an example, a camera 130 facing the entrance can be used and a camera 130 facing the exit can be used. The image(s) captured by the one or more cameras 130 can be communicated to and stored in server 125 along with identification information such as which tag(s) 115 was proximate to the camera 130 at the time the image was captured, time of day, etc. In some embodiments, if it is determined that a tag 115 is near an entrance/exit of a premises and was previously located on the premises (e.g., the tag 115 is leaving the premises), the tag 115 can activate the location detection capability to track the tag 115.

In some embodiments, one or more of the devices shown in FIG. 1 can be sold to a consumer as a package. For example, tags 115, gateways 110, and a local server can be sold to a consumer as a package. One or more applications can be provided to the consumer to be installed on a mobile device 120 of the consumer (e.g., a smartphone). In some embodiments, when a gateway 110 or a local server is connected to the Internet, an automated WiFi set-up of the system can be performed. Information gathered during the automated set-up can be transferred to the server 125 via the Internet. The automated WiFi set-up can include associating a gateway 110 with a system of the consumer (e.g., item management system 100) through appropriate and available authentication methods.

In such embodiments, the consumer can associate one or more gateways 110 and/or mobile devices 120 with the system 100. The associated gateways 110 and mobile devices 120 can create an authorized zone within which tags 115 are to be tracked via gateways 110 and mobile devices 120. The consumer can fix tags 115 to items that are to be tracked. When the consumer is ready to begin tracking the items, the tags 115 can be activated. Activating tags 115 can include applying battery power to the circuitry of the tags 115.

In some embodiments, one or more users can be alerted based on specified events. The user can be alerted in any suitable manner, such as via email, SMS text message, a voice call, a notification to a smartphone (e.g., a user device 120), etc. The specified events can include a tag 115 being in proximity of specified gateways 110 or mobile devices 120, a tag 115 being outside of a specified zone defined by one or more gateways 110 or mobile devices 120, a tag 115 being outside of communication range of gateways 110 and mobile devices 120, a tag 115 having a low battery power level, a tag 115 having been exposed to unacceptable environmental conditions (e.g., high vibration, high humidity, high temperature, etc.), etc. When alerted (e.g., via a smartphone alert), the user can be prompted to dismiss the alert or take an action. The action can include sending a message to an owner of the item to which the tag 115 is affixed, calling the police, filing a report (e.g., an insurance claim report), etc. In some embodiments, information collected by the server 125 can be used to automatically generate insurance forms for tagged items.

In some embodiments, a sweep can be performed at pre-determined intervals, such as every 24 hours or on demand. The sweep can include transmitting from the gateways 110 and mobile devices 120 a request for tags 115 to respond via the on-demand requests described in greater detail below. In such embodiments, the tags 115 can respond once and then return to normal operation. The tags 115 can be requested to provide any suitable information, such as location, motion, humidity, pressure, errors, etc. An inventory of tags 115 in communication range of the gateways 110 and mobile devices 120 can be taken based on the tags 115 that respond to the request. The sweep can be used to determine if any tags 115 are missing. Such a periodic inventory of tags 115 can be stored, for example, on the server 125 to be used for insurance claims forms, assisting police in a theft investigation, etc. In alternative embodiments, the sweep can include sweeping the gateways 110. For example, each gateway 110 can respond to a sweep request by providing all tags 115 that the gateway 110 is in communication range of. In some embodiments, a user can request appraisals for their valuables through the system 100. In some embodiments, system 100 (e.g., via server 125) can provide suggested values for tagged items. The system 100 can be configured to suggest values for any tagged items, such as vehicles, rigs, manufacturing equipment, tools, parts, supplies, etc. For example, if an item was tagged with a descriptor "Gucci® bag," then the system can provide suggested values of Gucci® bags found on the Internet. In another example, for an item described in the system 100 as "D105 lawnmower," the system can provide suggested values for John Deere brand model D105 (or similar) lawnmowers. In yet another example, for an item described as a "250 gal tantalum drum," the system 100 can provide suggested values for containers made of tantalum that can hold 250 gallons of product or similar items. Such suggested prices can be accompanied with images of the items with the suggested price. The appraisals performed in response to the user's request can be stored in a database, which can be stored on server 125.

In some embodiments, one or more gateways 110 and/or mobile devices 120 can be configured to communicate with a security system. For instance, if it is determined that one or more tags 115 are not within communication range of a gateway 110 or a mobile device 120, the one or more gateways 110 or mobile devices 120 can indicate to the security system to alarm. In an illustrative embodiment, server 125 can determine that one or more tags 115 are not within an authorized zone based on a communication received from the one or more tags 115. The server 125 can indicate to a gateway 110 connected to the security system to alarm the security system. In another illustrative embodiment, a gateway 110 located at an exit of a user's premises can detect that a tag 115 is leaving the premises. The gateway 110 can communicate an alarm indicating such to the security system. In yet another illustrative embodiment, a sweep of the system 100 can be performed and one or more tags 115 can be determined to be missing based on the sweep. A gateway 110 can communicate an alarm indicating such to the security system. In some embodiments, information regarding a missing tag 115 or a tag 115 that is outside of an authorized location can be transmitted to the server 125 and the server 125 can alarm the security system.

Figure 2:
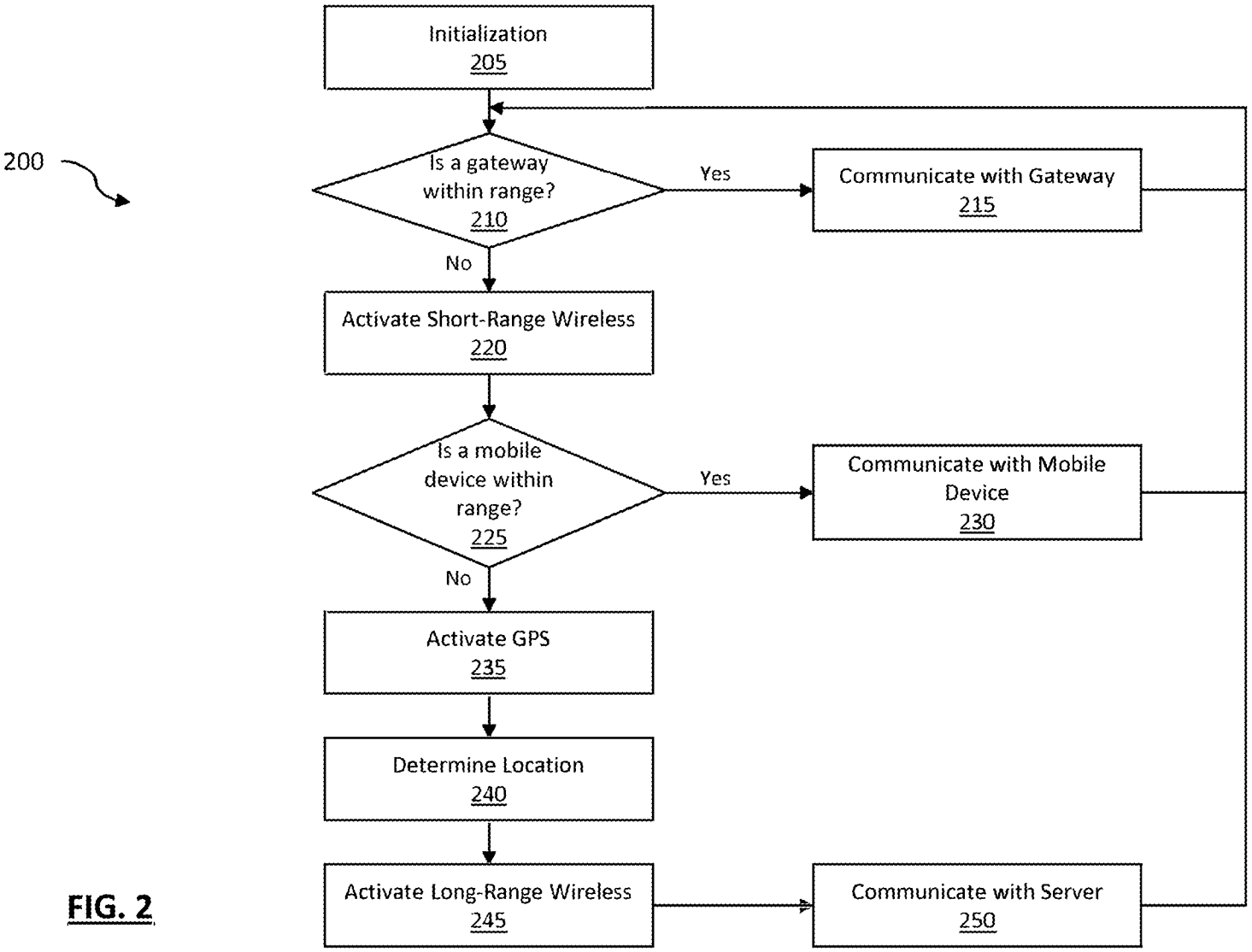
FIG. 2 is a flow diagram of a method for communicating a tag's location to a server in accordance with an illustrative embodiment.

FIG. 2 is a flow diagram of a method for communicating a tag's location to a server in accordance with an illustrative embodiment. In alternative embodiments, additional, fewer, and/or different operations may be performed. Also, the use of a flow diagram and arrows is not meant to be limiting with respect to the flow or order of operations. In some embodiments, the operations of the method 200 are performed by a tag 115. The method 200 includes initialization 205, determining whether a gateway is within range 210, communicating with the gateway 215, activating short-range wireless 220, determining if a mobile device is within range 225, communicating with the mobile device 230, activating GPS 235, determining a location 240, activating long-range wireless 245, and communicating with a server 250.

In an operation 205, a tag 115 can be initialized. In some embodiments, initialization 205 can include initializing a plurality of devices such as one or more tags 115, one or more mobile devices 120, and/or one or more gateways 110. Initialization 205 can include turning on a tag 115 and/or indicating to the tag 115 to begin operating. In some embodiments, initialization 205 can include transferring information to the tag 115. The information can be transmitted to the tag 115 in any suitable manner. For example, in some embodiments, initialization information can be transmitted via a wired connection from a computing device paired with the tag 115. In such embodiments, pairing a computing device with the tag 115 and using a wired connection can be for security reasons, thereby making it more difficult for a tag 115 to be tampered with by unauthorized individuals. For example, the tag 115 may not receive initialization information from an unpaired computing device or may not receive initialization information from a wireless connection. In other embodiments, unpaired computing devices and/or wireless communications can be used to transmit initialization information to the tag 115.

The initialization information can include information regarding the network with which the tag 115 is to be associated with. As indicated above and discussed in greater detail below, the tag 115 can be used to monitor the location of the tag 115 within an authorized area. The tag 115 can transmit location information when the tag 115 determines that the tag 115 is outside of the authorized area. Thus, initialization information can include information to assist the tag 115 in determining whether the tag 115 is in an authorized area. For example, such information can include a list of authorized gateways 110, authorized mobile devices 120, network communication information such as security codes or passwords, location information of authorized areas (e.g., coordinates of authorized locations such as a warehouse, a transit route, a manufacturing plant, etc.), etc.

In some embodiments, initialization 205 includes applying battery power to a tag 115. After power is applied to the tag 115, the tag 115 can automatically scan for other Bluetooth® devices, such as mobile devices 120. A mobile device 120 (e.g., a smartphone running an appropriate application) can be used to communicate with the tag 115. The tag 115 can transmit identification information to the mobile device 120 (e.g., an identification code, a serial number, etc.). The mobile device 120 can transmit to the server 125 the identification information and other relevant information such as a description of the item to which the tag 115 is attached, which can be entered into the mobile device 120 via a user interface. The description of the item can include a purchase price, appraised value, a model year, a make, a model, condition, identifying features, pictures, notes, comments, etc. The server 125 can store the received information and maintain records of the tag 115 (e.g., future reported locations, association with the system 100, a history of reported locations, etc.).

The authorized gateways 110 and the authorized mobile devices 120 can be gateways 110 and mobile devices 120 that are associated with an authorized network and/or define the authorized area. That is, the communication range of the tags 115 with the authorized gateways 110 and the authorized mobile devices 120 can be the authorized area. If a tag 115 is outside of the authorized area, the tag 115 can be configured to transmit the location of the tag 115 to the server 125, as described in greater detail below. Similarly, unauthorized gateways 110 and unauthorized mobile devices 120 can be gateways 110 and mobile devices 120 that are not associated with the authorized area. The unauthorized gateways 110 and unauthorized mobile devices 120 can be gateways 110 and mobile devices 120 that are not part of a user's system (e.g., a neighbor's router, a stranger's mobile device, etc.) or any other gateway 110 or mobile device 120 that is not used to determine whether tags 115 are in an authorized area (e.g., an employee's personal mobile device, a router in an office area, etc.).

In some embodiments, initialization 205 can include sending initialization information to gateways 110 and mobile devices 120. In such embodiments, the initialization information can include a list of tags 115. The list of tags 115 can be of tags 115 that are associated with the system of gateways 110 and mobile devices 120. For example, the list of tags 115 can include all tags 115 that are associated with a business, a warehouse, etc. The list of tags 115 can include identification information of the tags 115 such as an identification number or descriptor, communication information such as security codes or deciphering information, etc. In some embodiments, gateways 110 and mobile devices 120 of a system will only communicate with tags 115 that are associated with the system. For instance, a lawn grooming company's system can have gateways 110 that only communicate with tags 115 that are located on the equipment of the lawn grooming company. If a tag 115 from another company is within communication range of the lawn grooming company's gateways 110, the gateways 110 can ignore the other company's tag 115. In alternative embodiments, gateways 110 and mobile devices 120 can communicate with any tag 115. In such embodiments, if a given tag is not a tag 115 that is associated with a system of the gateway 110 or mobile device 120, the gateway 110 or mobile device 120 can transmit location information of the given tag to the server 125 with an indication that the given tag is not associated with the system. In some embodiments, the gateway 110 can transmit the location information of the given tag to the appropriate server 125 of another system.

In an operation 210, it is determined whether a gateway is within communication range. For instance, a tag 115 can transmit a signal via WiFi, thereby requesting a response from a gateway 110. For example, the transmitted signal can be a ping to gateways 110. If a gateway 110 receives the signal transmitted by the tag 115, the gateway 110 can transmit a signal via WiFi to the tag 115 acknowledging that the signal transmitted by the tag 115 was received.

In an operation 215, the tag 115 can communicate with the gateway 110. The communication with the gateway 110 can include identification information of the tag 115. Such information can include an identification number, code, description, etc. of the tag 115, and/or information identifying the system to which the tag 115 belongs. The communication with the gateway 110 can also transmit status information such as a battery power level of the tag 115, indication of whether the tag 115 has encountered an error (e.g., an error code can be sent to the gateway 110), a time indication, etc. In some embodiments, the time indication can be a time stamp. In alternative embodiments, the time indication can be an indication of how long the tag 115 has been running. Such information can be used (e.g., by server 125) to determine whether the tag 115 has been turned off. If the tag 115 has been turned off unexpectedly, it may be determined that unauthorized activity has taken place (e.g., that the tag 115 was turned off so that the item to which the tag 115 is affixed to was taken to an unauthorized location). The gateway 110 can, in turn, transmit the information received from the tag 115. The gateway 110 can also transmit information such as the signal strength of the signal received from the tag 115, a battery life of the gateway 110, a location of the gateway 110, an error code of the gateway 110, etc.

In some embodiments, operation 215 can be concurrent with operation 210. For example, the signal transmitted by the tag 115 to determine whether a gateway 110 is within communication range of the tag 115 can include the identification information, status information, etc. transmitted in operation 215. In such an embodiment, the tag 115 need not transmit a response to the gateway 110 when the tag 115 receives the indication from the gateway 110 that the gateway 110 received the signal from the tag 115. In alternative embodiments, operation 215 can be performed in response to receiving the indication from a gateway 110 that the gateway 110 received the signal from the tag 115.

In some embodiments, operation 210 can include a short message (e.g., a ping) to determine if a gateway 110 is within communication range when the previous iteration of method 200 determined that the tag 115 was not within communication range of a gateway 110. In such an embodiment, operation 210 can include a long message (e.g., including the information communicated to the gateway 110 in operation 215) when the previous iteration of method 200 determined that the tag 115 was within communication range of a gateway 110. That is, in such an embodiment, if the tag 115 previously determined that the tag 115 was within communication range of a gateway 110, then the signal transmitted to the gateway 110 to determine if the tag 115 is still within range of the gateway 110 can include identification information, status information, etc. In such an embodiment, the tag 115 can assume that the tag 115 is still within communication range of a gateway 110 if, in the previous iteration of method 200, the tag was in communication range of the gateway 110. If the tag 115 does not receive an acknowledgement of the signal transmitted to the gateway 110, the tag 115 can determine that it is not within communication range of the gateway 110. If, in the previous iteration of method 200, it was determined that the tag 115 was not within communication range of a gateway 110, the tag 115 can assume that it still is not within communication range of a gateway 110, but attempt to contact a gateway 110 using a short message, such as a ping signal. Such an embodiment can reduce the total amount of transmitting and listening of the tag 115, thereby reducing the amount of battery consumed by the tag 115. Thus, in such an embodiment, the battery of the tag 115 may last a longer amount of time compared to other embodiments.

As illustrated in FIG. 2, if the tag 115 determines that a gateway 110 is within communication range and communicates with the gateway 110 (e.g., via operations 210 and 215), the method can return to operation 210. If the tag 115 determines that a gateway 110 is not within communication range (e.g., does not receive a response from a gateway 110 indicating that a gateway 110 received the signal from the tag 115), operation 220 can be performed. In operation 220, a short-range wireless communication capability of tag 115 is activated. In some embodiments, activating a communication capability can include providing power to a component (such as a transceiver computing chip), changing a mode of a transceiver, etc. In some embodiments, the short-range wireless communication device can be a Bluetooth® enabled device. Although FIG. 2 shows a short-range wireless communication capability being activated in operation 220, in alternative embodiments any suitable communication capability can be activated. As shown in FIG. 2, the short-range wireless device of tag 115 is not activated if the tag 115 is within communication range of a gateway 110. In some embodiments, operation 220 can also include deactivating mid-range communication capabilities used to communicate with gateways 110 (e.g., WiFi).

In operation 225, it is determined whether a mobile device 120 is within communication range of a tag 115. In some embodiments, operation 225 is used to determine if devices other than a mobile device 120 is within communication range of the tag 115. In such embodiments, the other devices can communicate using the short-range wireless capabilities activated in operation 220. For instance, a tag 115 can transmit a signal via Bluetooth® communications, thereby requesting a response from a mobile device 120. For example, the transmitted signal can be a ping to mobile devices 120. If a mobile device 120 receives the signal transmitted by the tag 115, the mobile device 120 can transmit a signal via Bluetooth® to the tag 115 acknowledging that the signal transmitted by the tag 115 was received.

In an operation 230, the tag 115 can communicate with the mobile device 120. The communication with the mobile device 120 can include identification information of the tag 115. Such information can include an identification number, code, description, etc. of the tag 115, information of the system to which the tag 115 belongs, etc. The communication with the mobile device 120 can also transmit status information such as a battery power level of the tag 115, indication of whether the tag 115 has encountered an error (e.g., an error code can be sent to the mobile device 120), a time indication, etc. The mobile device 120 can, in turn, transmit the information received from the tag 115. The mobile device 120 can also transmit information such as the signal strength of the signal received from the tag 115, a battery life of the mobile device 120, a location of the mobile device 120, an error code of the mobile device 120, etc.

In some embodiments, operation 230 can be concurrent with operation 225. For example, the short-range wireless signal transmitted by the tag 115 to determine whether a mobile device 120 is within communication range of the tag 115 can include the identification information, status information, etc. transmitted in operation 230. In such an embodiment, the tag 115 need not transmit a response to the mobile device 120 when the tag 115 receives the indication from the mobile device 120 that the mobile device 120 received the signal from the tag 115. In alternative embodiments, operation 230 can be performed in response to receiving the indication from a mobile device 120 that the mobile device 120 received the signal from the tag 115.

In some embodiments, operation 225 can include a short message to determine if a mobile device 120 is within communication range when the previous iteration of method 200 determined that the tag 115 was not within communication range of a mobile device 120. In such an embodiment, operation 225 can include a long message (e.g., including the information communicated to the mobile device 120 in operation 230) when the previous iteration of method 200 determined that the tag 115 was within communication range of a mobile device 120. That is, in such an embodiment, if the tag 115 previously determined that the tag 115 was within communication range of a mobile device 120, then the signal transmitted to the mobile device 120 to determine if the tag 115 is still within range of the mobile device 120 can include identification information, status information, etc. In such an embodiment, the tag 115 can assume that the tag 115 is still within communication range of a mobile device 120 if, in the previous iteration of method 200, the tag was in communication range of the mobile device 120. If the tag 115 does not receive an acknowledgement of the signal transmitted to the mobile device 120, the tag 115 can determine that it is not within communication range of the mobile device 120. If, in the previous iteration of method 200, it was determined that the tag 115 was not within communication range of a mobile device 120, the tag 115 can assume that it still is not within communication range of a mobile device 120, but attempt to contact a mobile device 120 using a short message, such as a ping signal. Such an embodiment can reduce the total amount of transmitting and listening of the tag 115, thereby reducing the amount of battery consumed by the tag 115. Thus, in such an embodiment, the battery of the tag 115 may last a longer amount of time compared to other embodiments.

As illustrated in FIG. 2, if the tag 115 determines that a mobile device 120 is within communication range and communicates with the mobile device 120 (e.g., via operations 225 and 230), the method can return to operation 210. In some embodiments, returning to operation 210 includes deactivating the short-range wireless capability activated in operation 220. In some embodiments, instead of returning to operation 210 after completing operation 230, method 200 can return to operation 225. That is, in such embodiments, once the tag 115 is in communication with a mobile device 120, the tag 155 will not search for another device (e.g., a gateway 110 or another mobile device 120) until communication is lost with the mobile device 120. In such embodiments, when the tag 115 loses communication with the mobile device 120, method 200 can return to operation 210.

If the tag 115 determines that a mobile device 120 is not within communication range (e.g., does not receive a response from a mobile device 120 indicating that a mobile device 120 received the signal from the tag 115) in operation 225, operation 235 can be performed. In operation 235, a GPS location detection capability is activated. In some embodiments, operation 235 can include activating any suitable location detection capability that can be different than GPS. In some embodiments, operation 235 can include deactivating the short-range wireless communication capability activated in operation 220. In an operation 240, the location of the tag 115 can be determined. The location of the tag 115 can be determined using the GPS capability activated in operation 235. Any suitable method can be used to determine the location of the tag 115.

In an operation 245, long-range wireless communication capability is activated. In some embodiments, long-range communication includes using a cellular network. In some embodiments, long-range wireless communication includes any suitable method of communicating with a server 125 that is not via an authorized gateway 110 or authorized mobile device 120.

In an operation 250, the tag 115 can communicate with the server 125. The communication with the server 125 can include identification information of the tag 115. Such information can include an identification number, code, description, etc. of the tag 115, information of the system to which the tag 115 belongs, etc. The communication with the server 125 can also transmit status information such as a battery power level of the tag 115, indication of whether the tag 115 has encountered an error (e.g., an error code can be sent to the mobile device 120), a time indication, etc. Communicating with the server 125 can include transmitting the location of the tag 115, as determined in operation 240.

As shown in FIG. 2, after the tag 115 has communicated with the server 125 in operation 250, method 200 can return to operation 210. The order of operations illustrated in FIG. 2 is meant to be illustrative only. For example, in some embodiments, operations 235 and 245 can be concurrent. Also, as described above, operations 210 and 215 communicate using mid-range wireless communications and operations 225 and 230 communicate use short-range wireless communications. In alternative embodiments, operations 225 and 230 communicate using mid-range wireless communications and operations 210 and 215 communicate use short-range wireless communications. In such embodiments, operation 220 includes activating mid-range wireless capabilities. Whether short- or mid-range wireless communications are used in operations 210 and 215 and the other used in operations 225 and 230 can be dependent on the battery power used by the tag 115. That is, the order that the communication types are cycled through can be chosen to maximize the battery life of the tag 115. For instance, in some instances, a tag 115 is in communication range of a mobile device 120 more than it is in communication range of a gateway 110. In such an example, operations 210 and 215 can use short-range wireless communications to communicate with a mobile device 120 and operations 225 and 230 can use mid-range wireless communications to communicate with gateways 110.

In some embodiments, one or more time delays can be incorporated into method 200. For instance, while the tag 115 is within communication range of a gateway 110, the tag 115 can wait a first time period before performing operation 210 again. The first time period can be any suitable time period such as one second, ten seconds, one minute, ten minutes, one hour, etc. In an illustrative embodiment, the first time period can be five minutes. Similarly, while the tag 115 is within communication range with a mobile device 120, the tag 115 can wait a second time period before performing operation 210 (or operation 225, depending upon the embodiment) again. The second time period can be any suitable time period such as one second, ten seconds, one minute, ten minutes, one hour, etc. In an illustrative embodiment, the second time period can be five minutes. In some embodiments, the first time period and the second time period are the same. In alternative embodiments, the first time period is different than the second time period. Similarly, while the tag 115 is not within communication with either a gateway 110 or a mobile device 120, the tag 115 can wait a third time period before performing operation 210 again. The third time period can be any suitable time period such as one second, ten seconds, one minute, ten minutes, one hour, etc. In an illustrative embodiment, the third time period can be five minutes. In some embodiments, the third time period can be the same as the first time period and/or the second time period. In alternative embodiments, the third time period is different than the first time period and the second time period.

In some embodiments, after communicating with another device (e.g., via operation 215, operation 230, or operation 250), the tag 115 deactivates the communication capability that was used to communicate with the other device. For example, after communicating with a mobile device 230 via Bluetooth®, the tag 115 can deactivate a communications chip that allows the tag 115 to communicate via Bluetooth®. In such embodiments, the tag 115 can re-activate the appropriate communications ability in the next iteration of method 200. Deactivating communications capabilities when the tag 115 is not communicating with another device (or attempting to communicate with another device) will help to conserve battery power, thereby allowing the tag 115 to be operational for longer periods of time without charging or battery changes.

In some embodiments, the tag 115 provides its location on demand. After communicating with another device (e.g., via operation 215, operation 230, or operation 250), the tag 115 can deactivate the communications method used to communicate with the device, as explained above. After a first predetermined interval (e.g., one second, two seconds, ten seconds, one minute, etc.), the tag 115 re-activates the communications method to listen for a signal from the device with which the tag 115 previously communicated with. The tag 115 can receive a signal from the device indicating a request for the location of the tag 115 (or any other suitable information). In such embodiments, the tag 115 can determine its location via any method disclosed herein and transmit the location to the device. The tag 115 can continue to determine and transmit its location at a second predetermined interval (e.g., every second, every two seconds, every ten seconds, every minute, every ten minutes, every hour, etc.) until the tag 115 receives a signal to stop.

For example, a tag 115 can communicate with a gateway 110 via operation 215 and can deactivate its WiFi capability. After ten seconds, the tag 115 can reactivate its WiFi capability and can listen for a signal from the gateway 110. If no signal is received (e.g., within one second, ten seconds, etc.), the tag 115 can deactivate its WiFi capability and continue with method 200. If the tag 115 receives an on-demand location request from the gateway 110 (which can originate from another device such as server 125 or mobile device 120), the tag 115 can determine its location and transmit to the gateway 110 its location every minute. The tag 115 can communicate its location via any suitable method. In some embodiments, the tag 115 will continue to transmit its location via the communication method used to receive the on-demand location request (e.g., WiFi). In alternative embodiments, the tag 115 will transmit its location via whichever means is available (e.g., via a cellular network when no gateways 110 or mobile devices 120 are within communication range). Returning to the example, the tag 115 will continue to transmit its location until the tag 115 receives a request to stop the periodic location updates. In some embodiments, the on-demand location updates by the tag 115 can be concurrent with method 200. In alternative embodiments, method 200 can be paused while the tag 115 provides the on-demand location updates.

In some embodiments, one or more operations can be performed based on readings from one or more sensors on the tags 115. For example, the method 200 (e.g., excluding initialization 205) can be performed based on the one or more sensors. The sensors can include an accelerometer, a temperature probe, a moisture sensor, a pressure sensor, etc. In some embodiments, the method 200 (e.g., excluding initialization 205) can be performed when the tag 115 has been moved by a predetermined threshold, as measured by an accelerometer. The predetermined threshold can be any suitable distance, such as one inch, three inches, one foot, three feet, one mile, three miles, etc. In some instances, the accelerometer can be used to determine that the tag 115 has left an authorized area. Such a determination can trigger the performance of method 200 (e.g., excluding initialization 205). In another example, method 200 (e.g., excluding initialization 205) can be performed when the tag 115 detects a reading from the accelerometer above a predetermined threshold indicating that the tag 115 was dropped, hit, kicked, abused, crashed into, etc.

In some embodiments, method 200 (e.g., excluding initialization 205) can be performed when a temperature is outside of a predetermined range (e.g., above an upper threshold or below a lower threshold). Similarly, in some embodiments, method 200 (e.g., excluding initialization 205) can be performed when the moisture detected by the tag 115 is outside of a predetermined range (e.g., above an upper threshold or below a lower threshold). In some embodiments, method 200 (e.g., excluding initialization 205) can be performed when the pressure detected by the tag 115 is outside of a predetermined range (e.g., above an upper threshold or below a lower threshold).

Figure 3:
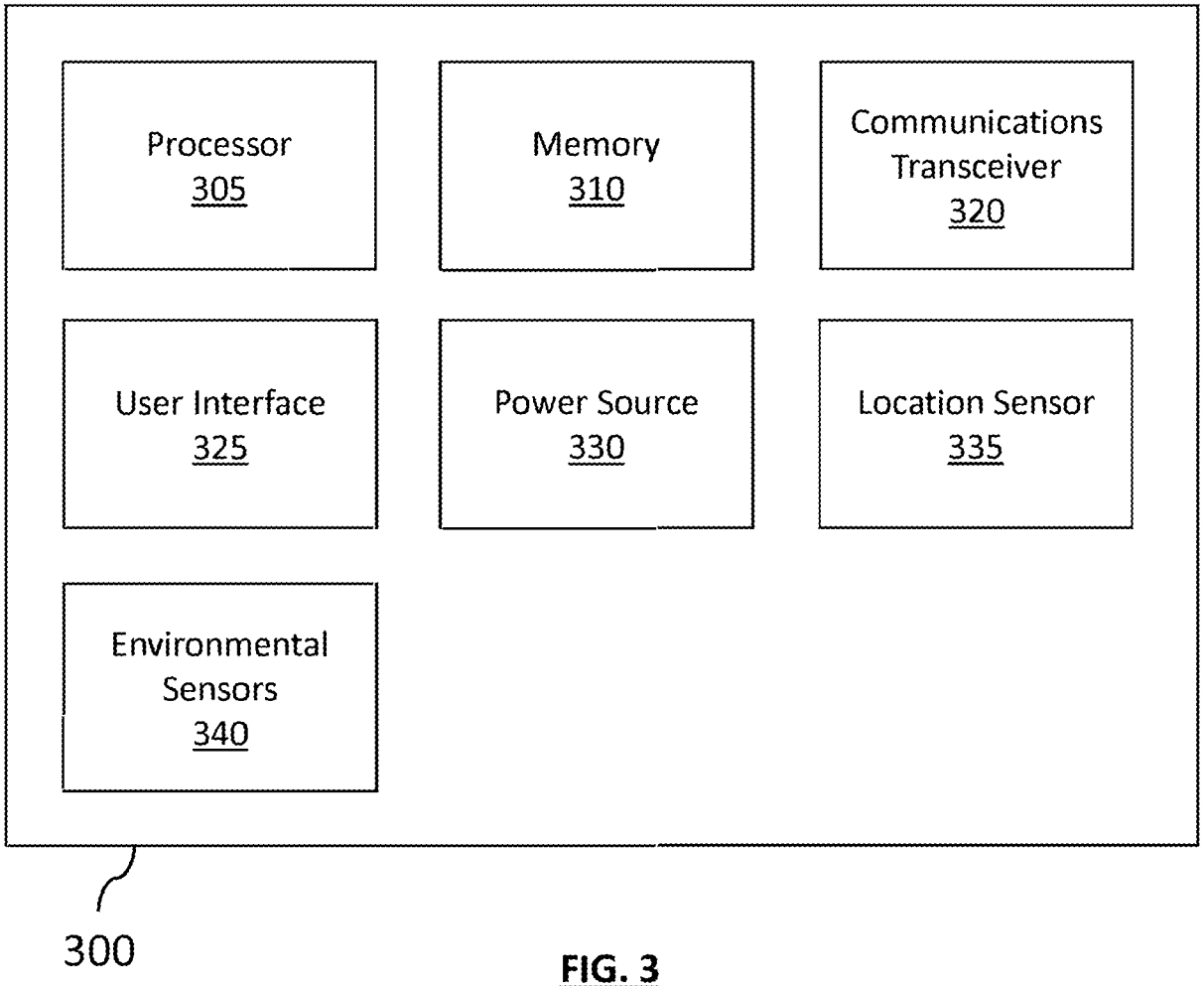
FIG. 3 is a block diagram of a computing device in accordance with an illustrative embodiment.

FIG. 3 is a block diagram of a computing device in accordance with an illustrative embodiment. In alternative embodiments, additional, fewer, and/or different elements may be used. A computing device 300 includes a processor 305, memory 310, a communications transceiver 320, a power source 330, a user interface 325, a location sensor 335, and environmental sensors 340. The item management system 100 can include one or more computing devices 300. For example, tags 115 can include an embodiments of computing device 300, gateways 110 can include an embodiment of computing device 300, mobile devices 120 can include an embodiment of computing device 300, the server 125 can include an embodiment of computing device 300, etc.

In some embodiments, computing device 300 includes a processor 305. Processor 305 can be configured to carry out and/or cause to be carried out one or more operations described herein. Processor 305 can execute instructions as known to those skilled in the art. The instructions may be carried out by one or more special purpose computers, logic circuits (e.g., programmable logic circuits (PLC)), and/or hardware circuits. Thus, processor 305 may be implemented in hardware, firmware, software, or any combination of these methods. The term "execution" is the process of running an application or the carrying out of the operation called for by an instruction. The instructions may be written using one or more programming languages, scripting languages, assembly languages, etc. Processor 305 executes an instruction, meaning that it performs the operations called for by that instruction. Processor 305 operably couples with memory 310, communications transceiver 320, power source 330, user interface 325, location sensor 335, environmental sensors 340, etc. to receive, to send, and to process information and to control the operations of the computing device 300. Processor 305 may retrieve a set of instructions from a permanent memory device such as a read-only memory (ROM) device and copy the instructions in an executable form to a temporary memory device that is generally some form of random access memory (RAM). Computing device 300 may include a plurality of processors that use the same or a different processing technology. In an illustrative embodiment, the instructions may be stored in memory 310.

In some embodiments, computing device 300 includes memory 310. Memory 310 can be an electronic holding place or storage for information so that the information can be accessed by processor 1205 using any suitable method.

Memory 310 can include, but is not limited to, any type of random access memory (RAM), any type of read-only memory (ROM), any type of flash memory, etc. such as magnetic storage devices (e.g., hard disk, floppy disk, magnetic strips, etc.), optical disks (e.g., compact disk (CD), digital versatile disk (DVD), etc.), smart cards, flash memory devices, etc. Computing device 300 may have one or more computer-readable media that use the same or a different memory media technology. Computing device 300 may have one or more drives that support the loading of a memory medium such as a CD, a DVD, a flash memory card, etc.

In some embodiments, computing device 300 includes a communications transceiver 320. Communications transceiver 320 can be configured to receive and/or transmit information. In some embodiments, communications transceiver 320 can communicate information via a wired connection, such as an Ethernet connection, one or more twisted pair wires, coaxial cables, fiber optic cables, etc. In some embodiments, communications transceiver 320 can communicate information via a wireless connection using microwaves, infrared waves, radio waves, spread spectrum technologies, satellites, etc. Communications transceiver 320 can be configured to communicate with another device using cellular networks, local area networks, wide area networks, the Internet, etc. In some embodiments, one or more of the elements of computing device 300 communicate via wired or wireless communications. In some embodiments, communications transceiver 320 can include one or more transceivers. For example, tags 115 can include a communications transceiver 320 with a WiFi transceiver, a Bluetooth® transceiver, and a cellular transceiver.

In some embodiments, computing device 300 includes a power source 330. Power source 330 can be configured to provide electrical power to one or more elements of computing device 300. In some embodiments, power source 330 can include an alternating power source, such as available line voltage (e.g., 120 Volts (V) alternating current at 60 Hertz in the United States). Power source 330 can include one or more transformers, rectifiers, etc. to convert electrical power into power useable by the one or more elements of computing device 300, such as 1.5 V, 8 V, 12 V, 24 V, etc. Power source 330 can include one or more batteries.

In some embodiments, computing device 300 includes a user interface 325. User interface 325 can be configured to receive and/or provide information from/to a user. User interface 325 can be any suitable user interface. User interface 325 can be an interface for receiving user input and/or machine instructions for entry into computing device 300 using any suitable method. User interface 325 may use various input technologies including, but not limited to, a keyboard, a stylus and/or touch screen, a mouse, a track ball, a keypad, a microphone, voice recognition, motion recognition, disk drives, remote computing devices, input ports, one or more buttons, switches, dials, joysticks, etc. to allow an external source, such as a user, to enter information into computing device 300. User interface 325 can be used to navigate menus, adjust options, adjust settings, adjust display, etc. User interface 325 can be configured to provide an interface for presenting information from computing device 300 to external systems, users, or memory. For example, user interface 325 can include an interface for a display, a printer, a speaker, alarm/indicator lights, a network interface, a disk drive, a computer memory device, etc. User interface 325 can include a color display, a cathode-ray tube (CRT), a liquid crystal display (LCD), a plasma display, an organic light-emitting diode (OLED) display, etc.

In some embodiments, computing device 300 includes a location sensor 335. The location sensor 335 can be compatible with one or more global positioning systems (GPS) to determine the location of the computing device 300. In some embodiments, the location sensor 335 can be configured to determine the location of the computing device 300 using any suitable technology such as via a WiFi positioning system (e.g., Combain Positioning Services™ or any other suitable system for determining position via WiFi), cellular network triangulation, etc.

In some embodiments, computing device 300 can include environmental sensors 340. The environmental sensors 340 can be one or more sensors configured to detect environmental conditions of the computing device 300. For example, the environmental sensors 340 can include an accelerometer, a temperature probe, a humidity probe, a pressure sensor, etc.

Figure 4:
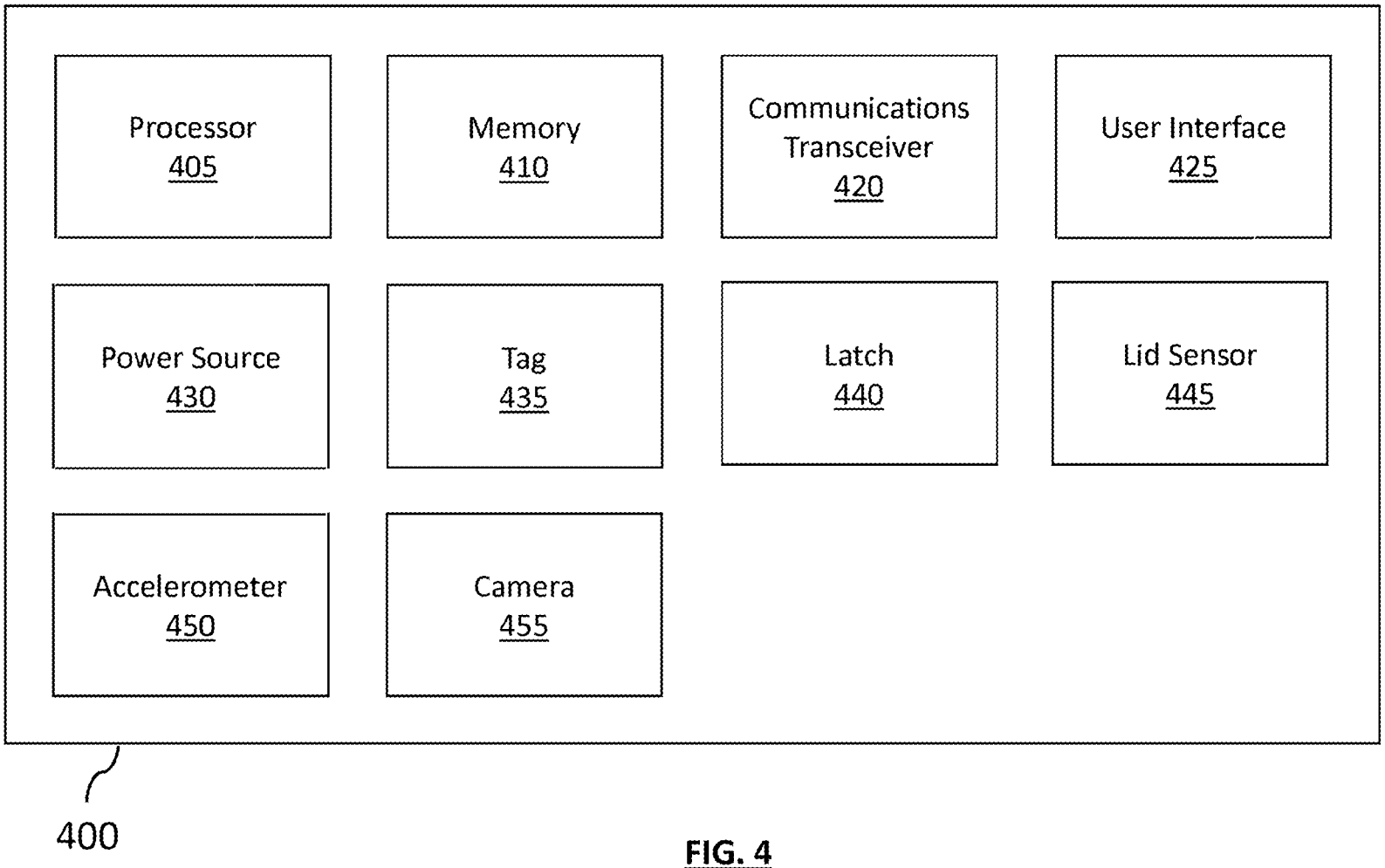
FIG. 4 is a block diagram of a trackable lockbox in accordance with an illustrative embodiment.

In some instances, the system 100 can be used to track items with tags 115 incorporated into the items. FIG. 4 is a block diagram of a trackable lockbox in accordance with an illustrative embodiment. In alternative embodiments, additional, fewer, and/or different elements can be used. In some embodiments, the trackable lockbox 400 is a jewelry box or any other lockbox. The trackable lockbox 400 can be, for example, a lockbox used by a business, such as a valet box for car keys. In such embodiments, the jewelry box (or other lockbox) may not look any different than a typical jewelry box that does not include an electronic tracking system and/or a remote access system. In some embodiments, a mobile device such as a smartphone is used to unlock and lock the trackable lockbox 400 via one or more passcodes entered into the mobile device. As shown in FIG. 4, the trackable lockbox 400 includes a processor 405, a memory 410, a communications transceiver 420, a user interface 425, a power source 430, a tag 435, a latch 440, a lid sensor 445, an accelerometer 450, and a camera 455. In some embodiments, a user can electronically lock and unlock a the lockbox 400; track and monitor the lockbox 400 within both an authorized area and globally through the use of PAN, LAN, and WAN networks; obtain alerts when the lockbox 400 is opened, moved within an area, or removed from the area; and track the lockbox 400 when removed from the area to assist in recovery of the lockbox 400.

In some embodiments, the lockbox 400 can be purchased by a user as a package with other materials and/or devices. The lockbox 400 can be equipped with an electronic lock as described above, batteries, and the tracking tags installed and can come with a gateway 110. The user can access an Internet-based application and set up an account. The user can download an application onto one or more computing devices, such as a laptop, a smartphone, a tablet, etc. The user can program the lockbox 400 with the gateway 110 to allow the gateway 110 to monitor the lockbox 400. The user can pair a computing device of the user (e.g., a user's smartphone) with the lockbox 400 (e.g., the tag 435) and provide the pairing information to a cloud computing device (e.g., including server 125). The user can define a specific code to open and to close the electronic lock of the lockbox 400. For example, an asterisk (*) can be used after a four digit code to lock the lockbox 400 and a hash (#) can be used after the four digit code to unlock the lockbox 400. In some embodiments, the lockbox 400 is smart enough to know that unless the lid is properly closed, the electronic lock will not be set, and the proper error code is provided to the user. In some embodiments, if the lockbox 400 is left unlocked for a user definable time, an alert is sent to the smartphone with a predetermined persistence. In an illustrative embodiment, the user receives alerts when the lockbox 400 is opened without the proper security code, is moved within certain proximity, is moved outside of a specified zone, and/or is removed from a specified area. In such an example, the user may dismiss the alert, call the location (e.g., a house phone), or call the police in response to the alert. In some embodiments, the user is alerted to low battery power of the lockbox 400. In some embodiments, alarms are provided if the lockbox 400 has been exposed to moisture, humidity, or temperature at unacceptable levels. Should the lockbox 400 be removed from an authorized location, the system automatically activates the dormant GPS chip and the cellular modem within the lockbox 400 to allow for tracking of the lockbox 400 outside of the authorized location to facilitate recovery of the lockbox 400.

In some embodiments, processor 405 is as described above with regard to processor 305, memory 410 is as described above with regard to memory 310, communications transceiver 420 is as described above with regard to communications transceiver 320, user interface 425 is as described above with regard to user interface 325, and power source 430 is as described above with regard to power source 430. In some embodiments, the power source 430 includes batteries that can be used to power the lockbox 400 for years. In some embodiments tag 435 includes some or all of the functionality as described above with regard to tag 115. For example, tag 435 can include the functionality of method 200. In such an example, tag 435 can be configured to perform an iteration of method 200 when the lockbox 400 determines via accelerometer 450 that the lockbox 400 has moved. Similarly, an iteration of method 200 can be performed when the lockbox 400 (and/or tag 435) determines that the lockbox 400 has been removed from an authorized area (e.g., a home, a bedroom, etc.).

In an illustrative embodiment, the lockbox 400 communicates with one or more authorized gateways, such as gateways 110. When the lockbox 400 is within communication range of the one or more authorized gateways 11*o*, the authorized gateways 110 that receives the signal from the lockbox 400 can transmit such information (as described above with regard to operation 215) to a server such as server 125, which can be a cloud computing server. The authorized gateways 110 can comprise a WiFi network. If the authorized gateways 110 within the WiFi network do not detect the lockbox 400 after a predetermined time or if the signal received from the lockbox 400 is below a low signal level threshold, one or more of the gateways 110 (and/or a local server and/or a server 125) can communicate to WiFi networks adjacent to the WiFi network of the authorized gateways 110. The adjacent WiFi networks can transmit signals in an attempt to communicate with and locate the lockbox 400. If an adjacent WiFi network is able to communicate with the lockbox 400, then the adjacent WiFi network can communicate to the server 125 (and/or a local server and/or an authorized gateway 110) the location of the lockbox 400. In some embodiments, more than one WiFi networks can be configured to automatically recognize the lockbox 400 and transmit the location to the server 125 (and/or a local server and/or an authorized gateway 110).

As discussed above, the lockbox 400 can communicate its location if the lockbox 400 determines that it is outside an authorized area. In some embodiments, gateways 110 can periodically transmit a secure location code to the lockbox 400. The secure location code can be a code that is unique to the system to which the lockbox 400 is associated. That is, the secure location code can be unique to the authorized gateways 110 and/or mobile devices 120. If the lockbox 400 does not receive the secure location code within a specified time, the lockbox 400 can activate a location detection capability of the lockbox 400 and transmit the location of the lockbox 400 to the server 125 and/or a mobile device 125 (e.g., a user's smartphone). The specified time can be any suitable amount of time, such as ten seconds, thirty seconds, one minute, one hour, one day, etc. In embodiments in which the lockbox 400 sends its location to a mobile device 125, the mobile device 125 can be configured to display a map indicating the location of the lockbox 400 based on the information received by the lockbox 400.

When the lockbox 400 determines that the lockbox 400 is not within an authorized zone, the lockbox 400 can transmit its location periodically. In some embodiments, the rate at which the lockbox 400 transmits its location is a fixed interval. The fixed interval can be any suitable time period, such as once a second, once every ten seconds, once every thirty seconds, once a minute, once every ten minutes, once an hour, etc. In an alternative embodiment, the lockbox 400 can update its location based on a reading from one or more sensors. For example, accelerometer 450 can be used to determine the frequency that the lockbox 400 transmits its location when the lockbox 400 determines that it is not in an authorized area. In such an example, the lockbox 400 can transmit its location more frequently when it is being moved than when it is stationary. In some embodiments, the lockbox 400 can transmit its location at a first periodic interval when moving and at a second periodic interval when stationary. The first periodic interval can be, for example, one to five seconds and the second periodic interval can be, for example, an hour. Other sensors can be used to determine the periodic interval that the lockbox 400 transmits its location. For example, a location detection capability can be used to determine the speed of the lockbox 400 and whether it is moved. The location detection capability can be used instead of or in conjunction with the accelerometer to determine the motion of the lockbox 400. Although the above description is discussed with regard to the lockbox 400 adjusting the periodic interval used to transmit its location, the same functionality can be used with tags 115 described above with regard to FIGS. 1 and 2.

In some embodiments, if there is an unauthorized opening of the lockbox 400 (e.g., the lockbox 400 is opened without entering the proper passcode), the system sends an alert to a user device 125 that the lockbox 400 has been opened. In some embodiments, if the box is left opened for more than a certain period of time, the system informs the user that the box has been left open.

As discussed above, when a gateway 110 receives a signal from the lockbox 400, the gateway 110 can transmit to the server 125 the signal strength of the signal received from the lockbox 400. When multiple gateways 110 can communicate with the lockbox 400, as the lockbox 400 is carried away, the varying signal strengths received by the gateways 110 can be used to determine a trajectory and/or a path of the moving lockbox 400. In some embodiments, when server 125 (or any other suitable device) receives information indicating that the lockbox 400 is leaving the premises, a triangulation calculation is performed by the server 125 (or any other suitable device), thereby determining the trajectory and/or path of the moving lockbox 400. The server 125 can determine that the lockbox 400 is headed for a nearby WiFi system. The nearby WiFi system can be provided with identification information of the lockbox 400 and the nearby WiFi system can be used to track the lockbox 400.

In such an embodiment, if there is no nearby WiFi system that can track the lockbox 400 and the system determines that the lockbox 400 is headed out of range of the WiFi system (e.g., a signal strength of the lockbox 400 is below a threshold), the closest WiFi system can be instructed by the server 125 to transmit a signal to the lockbox 400 indicating that the lockbox 400 is to activate the cellular communication and location detection capabilities of the lockbox 400 and transmit to the server 125 via the cellular communication capability the location of the lockbox 400. After the lockbox 400 receives the signal indicating that it should begin transmitting its location to the server 125 via cellular networks, the lockbox 400 can continue to ping WiFi and/or Bluetooth® devices. In some embodiments, if an authorized gateway 110 or mobile device 125 is within communication range, the lockbox 400 can deactivate the cellular communication and location detection capabilities. In alternative embodiments, the lockbox 400 can continue to transmit its location via cellular networks until the lockbox 400 receives a second signal from the WiFi device that transmitted the signal indicating that the lockbox 400 was to begin transmitting its location.

In some embodiments, power source 430 includes one or more energy generation systems. For example, power source 430 can include an electrical connection that can be used to charge batteries of the power source 430. In another example, one or more generators can be used to convert kinetic energy (e.g., shaking, rolling, rocking, etc.) of the lockbox 400 into electricity that can be used to charge batteries of the power source 430. Other examples include solar panels, electrical induction charging systems, hand cranks, etc. In some embodiments, the energy generation systems can be used to charge a capacitor such as a supercapacitor or ultracapacitor. The capacitor can be used to provide enough current to power the logic circuit to determine if the proper code has been entered (e.g., operation 605). In some embodiments, once the proper code is detected, a very small lever wedged appropriately disengages, thereby allowing a manual mechanism (e.g., a hand crank) to open the box. In an alternative embodiment, the detection of the proper code opens a small port hole on the outside of the lockbox 400 to permit charging of the box through an electrical connector.

In an illustrative embodiment, gentle side to side shaking of the jewelry box charges an internal battery or capacitor to power up the logic portion of the circuitry and the Bluetooth® or near-field communication (NFC) transceiver. The logic portion and the transceiver do not require much charge and an LED display in a discreet location could show that the lockbox 400 is ready to receive the authentication command to open (or close, as the case may be). If the correct code is detected, the LED will blink (or similar display) indicating that the lockbox 400 is ready to be unlocked. The internal logic will continue to cause the light to blink until there is enough charge for the lockbox 400 to unlock. A clicking sound and/or a display (e.g., by LED functions) indicates the jewelry box is ready to open. If the correct code is not detected, the side to side movement will continue charging the capacitor or battery but will not open the locking mechanism until the correct code is detected.

In another illustrative embodiment, the lockbox 400 can include a keypad or other user interface to allow the lockbox 400 to open. That is, the lockbox 400 can receive authentication from the user interface and unlock the lockbox 400 upon receipt of the authentication.

As shown in FIG. 4, in some embodiments, the lockbox 400 includes one or more cameras 455. In some embodiments, the camera 455 is configured to capture still images. In alternative embodiments, the camera 455 is configured to capture video. The camera 455 can be used to capture images in the event of an unauthorized opening of the lockbox 400. In some instances, the camera 455 can be configured to capture one or more images outside of the lockbox 400, thereby attempting to capture an image of the person opening the lockbox 400. In other embodiments, the camera 455 can be configured to capture one or more images of what is located inside of the lockbox 400, thereby documenting what is removed from the lockbox 400. The images captured by the camera 455 can be transmitted to the server 125 using any suitable communication method.

Figure 5:
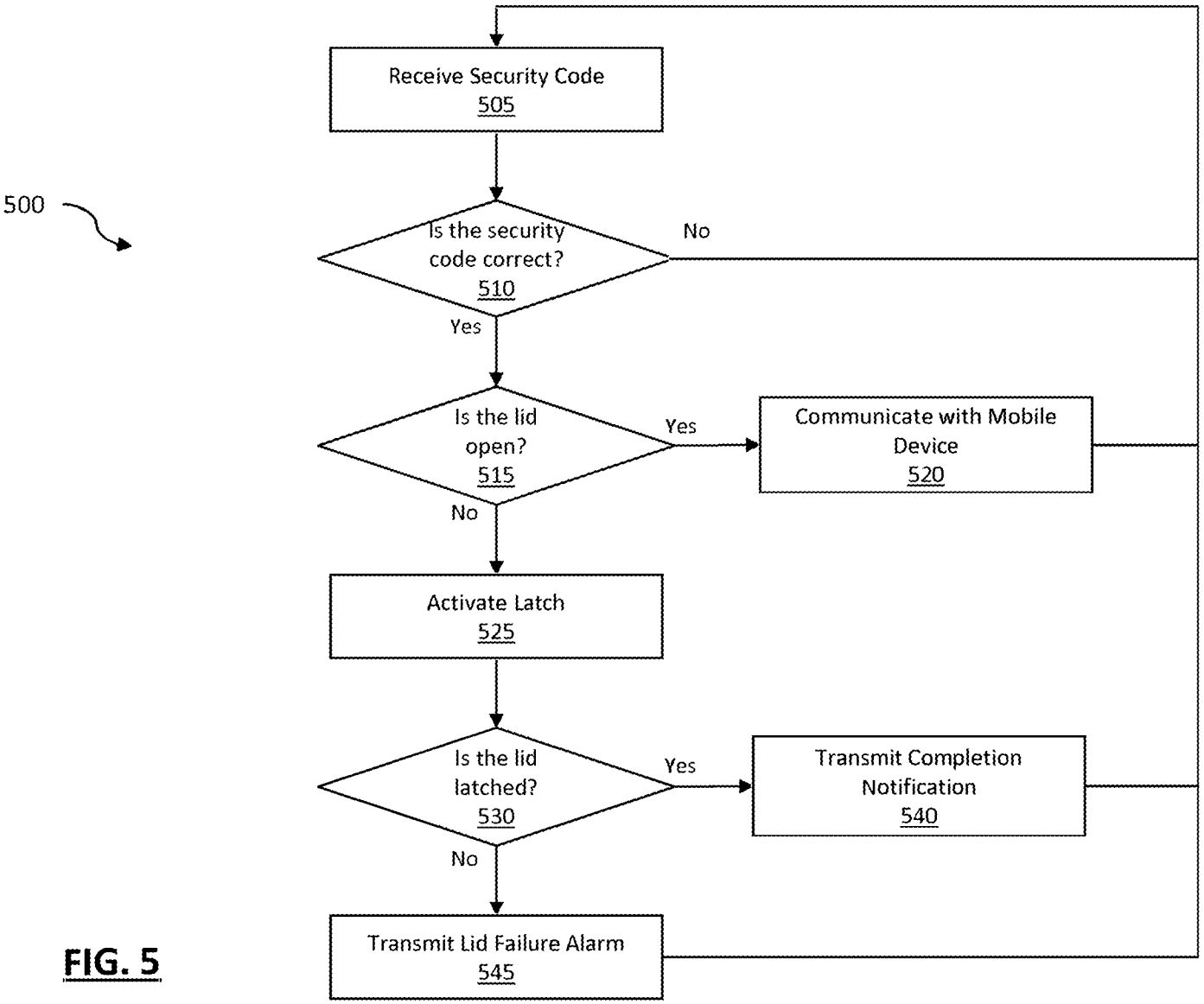
FIG. 5 is a flow diagram of a method for locking a lockbox in accordance with an illustrative embodiment.

FIG. 5 is a flow diagram of a method for locking a lockbox in accordance with an illustrative embodiment. In alternative embodiments, additional, fewer, and/or different operations may be performed. Also, the use of a flow diagram and arrows is not meant to be limiting with respect to the flow or order of operations. In some embodiments, locking method 500 is run in parallel or simultaneously with method 200.

In an operation 505, a security code can be received by the lockbox 400. In some embodiments, the security code is received from a remote keypad. In alternative embodiments, the security code can be received from a user device 125, such as a smartphone. In some embodiments, the user device 125 is paired to the lockbox 400 or otherwise authorized to operate the lockbox 400. The user device 125 can run an application configured to receive a user input. The user input can be compared by the user device 125 to determine whether the user input matches a passcode of the system. Any suitable user input can be used, such as a password, a personal identification number (PIN), a fingerprint, an auditory signal (e.g., a voice), etc. In some embodiments, the password can be provided by a near-field communication (NFC) device that has been paired with the lockbox 400. The user input can be compared to the passcode stored on the mobile device 125 (e.g., the fingerprint input to the mobile device 125 can be compared to a stored fingerprint known to be the fingerprint of the user). If the passcode and the user input match, the mobile device 125 can transmit to the lockbox 400 the security code. In some embodiments, the security code is the same as the passcode. In alternative embodiments, the security code is different than the passcode. For example, the passcode stored on the mobile device 125 can be a fingerprint or a PIN and the security code transmitted to the lockbox 400 can be a series of alphanumeric characters.

In some embodiments, a remote server can transmit a signal to the lockbox 400 to unlock the lockbox 400. Such a signal can be in place of the user entering a password, as explained above. In such an embodiment, the user can call a system administrator (or other appropriate personnel) and the system administrator can cause the server to transmit the signal to the lockbox 400, thereby unlocking the lockbox 400. In an alternative embodiment, the user can log into a website, thereby causing the server to transmit the signal to unlock the lockbox 400.

In an illustrative embodiment, when the signal is received by the lockbox 400, the lockbox 400 acknowledges the signal and turns on a blinking LED to indicate that the correct code has been received. If a gateway 110 (or other communication device) is not in communication with the lockbox 400 (e.g., the generic "open" code or other code indicating that the lockbox 400 is in communication with the gateway 110 is not detected) for a certain period of time, the lockbox 400 powers up the cellular transceiver. Similarly, if a remote server (e.g., server 125) does not receive an acknowledgement back from the gateway 110 indicating that the gateway 110 has successfully opened the lockbox 400 (or has successfully communicated with the lockbox 400) by a predetermined period, the remote server sends a signal to transmit the "open" code to the lockbox 400 using the cellular network. When the signal transmitted via the cellular network is received and decoded by the lockbox 400, the lockbox 400 can unlock. In some embodiments, the remote server transmits the "open" code via the cellular network after receiving an indication from a user (e.g., via a phone call to a complaint center or helpdesk) that the lockbox 400 should be opened. Once the server has received an acknowledgement from the lockbox 400, the remote server sends out a code to inform the lockbox 400 to start blinking the LED. When the lockbox 400 receives such a code, the cellular system is powered off and (the majority of or all of) the charge from shaking is directed towards powering the servo mechanism that unlocks the lockbox 400.

In an operation 510, the security code received from the mobile device 125 is compared to a stored security code. If the security code received from the mobile device 125 does not match the stored security code, locking method 500 returns to operation 505, in which the lockbox 400 can wait for another security code to be transmitted to the lockbox 400. If the security code received from the mobile device 125 matches the stored security code, operation 515 can be performed.

In operation 515, the lockbox 400 can determine whether the lid of the lockbox 400 is open. As described above, the lockbox 400 can be, in some instances, a lockbox with a lid, such as a jewelry box. In alternative embodiments, lockbox 400 can be any suitable shape or configuration that can be opened and closed. For example, lockbox 400 can, instead of a lid, include one or more doors. Also, in alternative embodiments, lockbox 400 can be a laptop computer. In such an embodiment, the lid can include the clamshell shape of the laptop and the latch 440 can keep the laptop closed.

In operation 515, the lockbox 400 can receive a signal from lid sensor 445. The lid sensor 445 can be any suitable device configured to determine if the lid of the lockbox 400 is open or closed. For example, the lid sensor 445 can be a switch. If the lid is open, in operation 520, the lockbox 400 can communicate with the mobile device 125. In an illustrative embodiment, the communication is an indication and/or notification that the lockbox 400 lid is open and, therefore, cannot be locked. In some embodiments, when the mobile device 125 received the communication that the lockbox 400 lid is open, the user of the mobile device 125 can be notified. In such an embodiment, the user can close the lid and re-enter the passcode (e.g., operation 505 can be performed). In some embodiments, operation 520 can be replaced with the lockbox 400 closing the lid. For example, one or more motors can be used to closed the lid of the lockbox 400. In such an embodiment, the locking method 500 can proceed to operation 235.

In the embodiment shown in FIG. 5, if the lid is closed, operation 235 is performed. In operation 235, the lockbox 400 can activate the latch 440. The latch 440 can be any suitable latch or locking mechanism configured to prevent the lid of the lockbox 400 from opening. The latch 440 can be operated in any suitable manner, including using one or more motors to actuate the latch 440. In an operation 530, the lockbox 400 can determine whether the latch 440 is closed. In some embodiments, the latch 440 can include a feedback signal that can indicate whether the latch 440 operated properly. For example, a switch can be used and the switch can be actuated when the locking mechanism is engaged. In another example, a position indicator on the actuator (e.g., the motor) can be used to determine whether the locking mechanism is engaged.

If the latch 400 did operate properly, operation 540 can be performed. In operation 540, the lockbox 400 can transmit to the mobile device 125 a signal indicating that the lockbox 400 is locked. When the mobile device 125 receives the indication that the lockbox 400 is locked, the mobile device 400 can notify the user of such. If the latch 400 did not operate properly, operation 545 can be performed. In operation 545, the lockbox 400 can transmit to the mobile device 125 a signal indicating that the lockbox 400 is not locked. In some embodiments, the transmitted signal can include an alarm indication. When the mobile device 125 receives the indication that the lockbox 400 is not locked, the mobile device 400 can notify the user of such, for example via an alarm on the mobile device 125. For example, the mobile device 125 can prompt the user to inspect the lockbox 400. In some embodiments, a work order or notification email can be prepared by the mobile device 125 based on receiving the indication that the lid is not latched.

Figure 6:
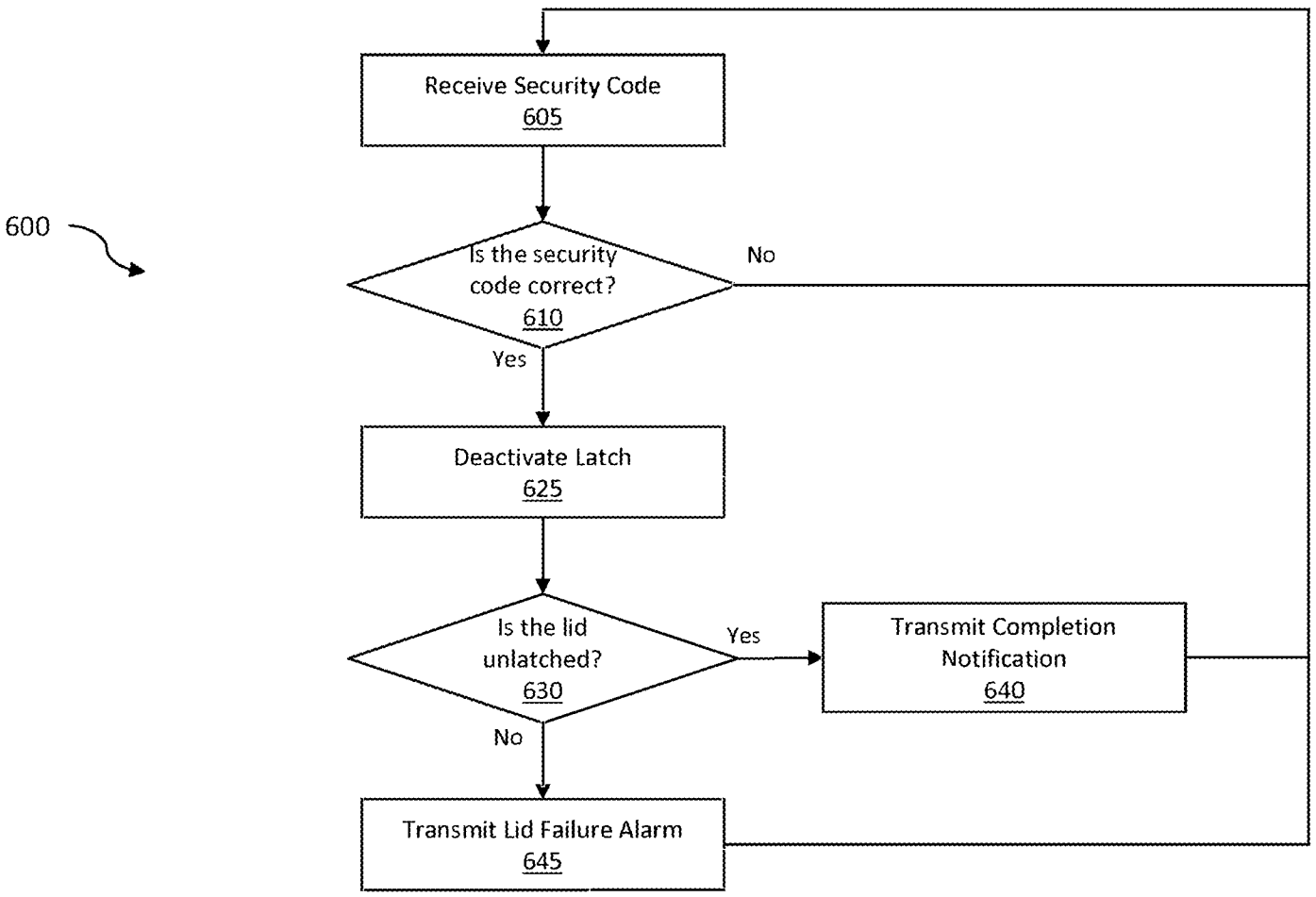
FIG. 6 is a flow diagram of a method for unlocking a lockbox in accordance with an illustrative embodiment.

FIG. 6 is a flow diagram of a method for unlocking a lockbox in accordance with an illustrative embodiment. In alternative embodiments, additional, fewer, and/or different operations may be performed. Also, the use of a flow diagram and arrows is not meant to be limiting with respect to the flow or order of operations. In some embodiments, unlocking method 600 is run in parallel or simultaneously with method 200 and/or locking method 500.

As described above with regard to operation 505, in operation 605 the lockbox 400 can receive a security code. As described above with regard to operation 510, in operation 610 the lockbox 400 can determine if the security code is correct. If the security code is incorrect, the unlock method 600 can return to operation 605. If the security code is correct, then operation 625 can be performed. In operation 625, the latch 440 can be deactivated. Using similar techniques as described above with regard to operation 530, in operation 630, the lockbox 440 can determine if the lid is unlatched. If the lid is determined to be unlatched, the lockbox 440 can transmit a completion notification to the mobile device 125 in operation 640. When the mobile device 125 receives such a notification, the mobile device 125 can notify the user that the lockbox 400 is unlocked. If the lid is determined to still be latched, a lid failure alarm can be transmitted to the mobile device 125 in operation 645. When the mobile device 125 receives the lid failure alarm, the mobile device 400 can notify the user of such, for example via an alarm on the mobile device 125. For example, the mobile device 125 can prompt the user to inspect the lockbox 400. In some embodiments, a work order or notification email can be prepared by the mobile device 125 based on receiving the indication that the lid is still latched.

Figure 7A:
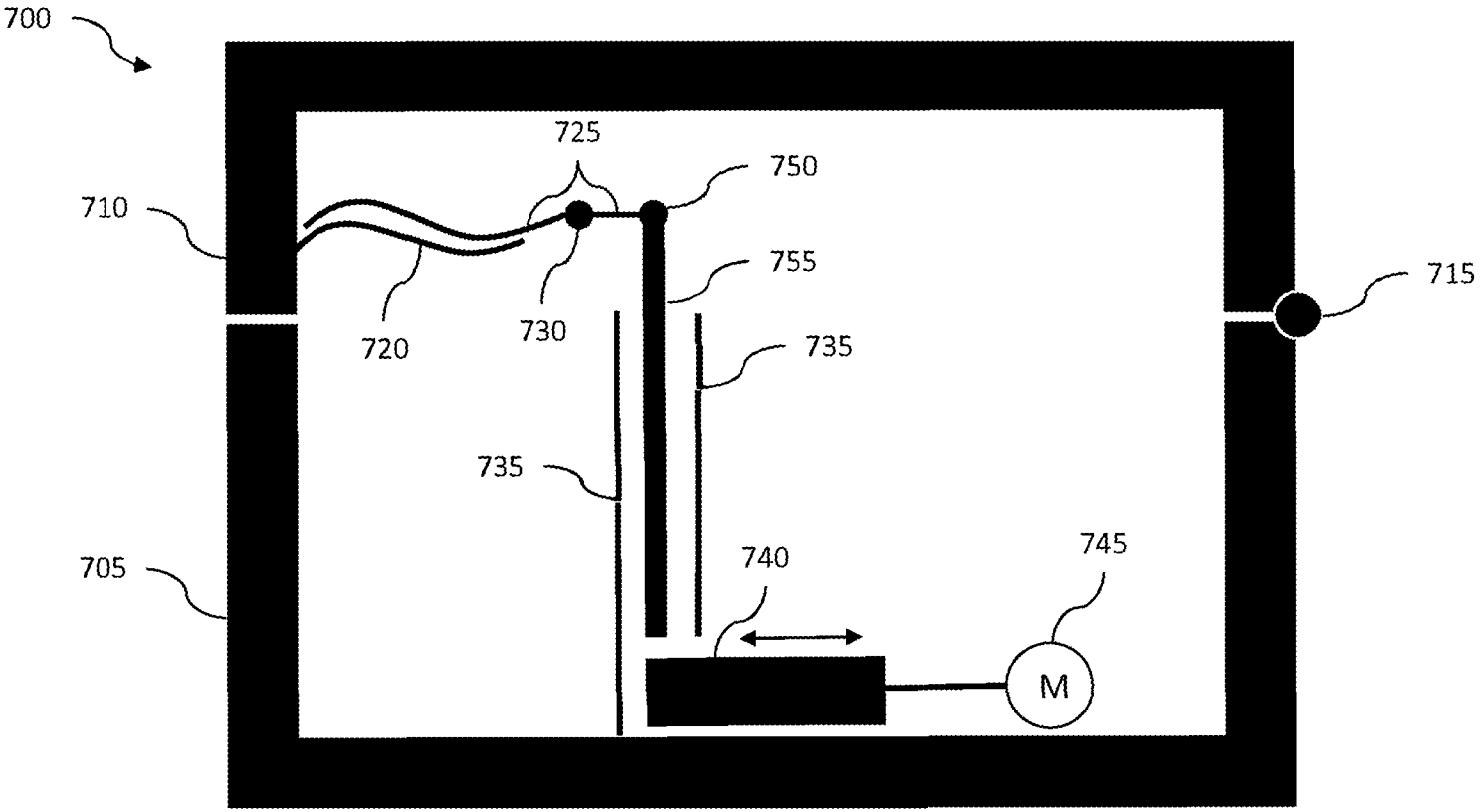
FIGS. 7A and 7B illustrate a locking mechanism of a lockbox in accordance with an illustrative embodiment.
Figure 7B:
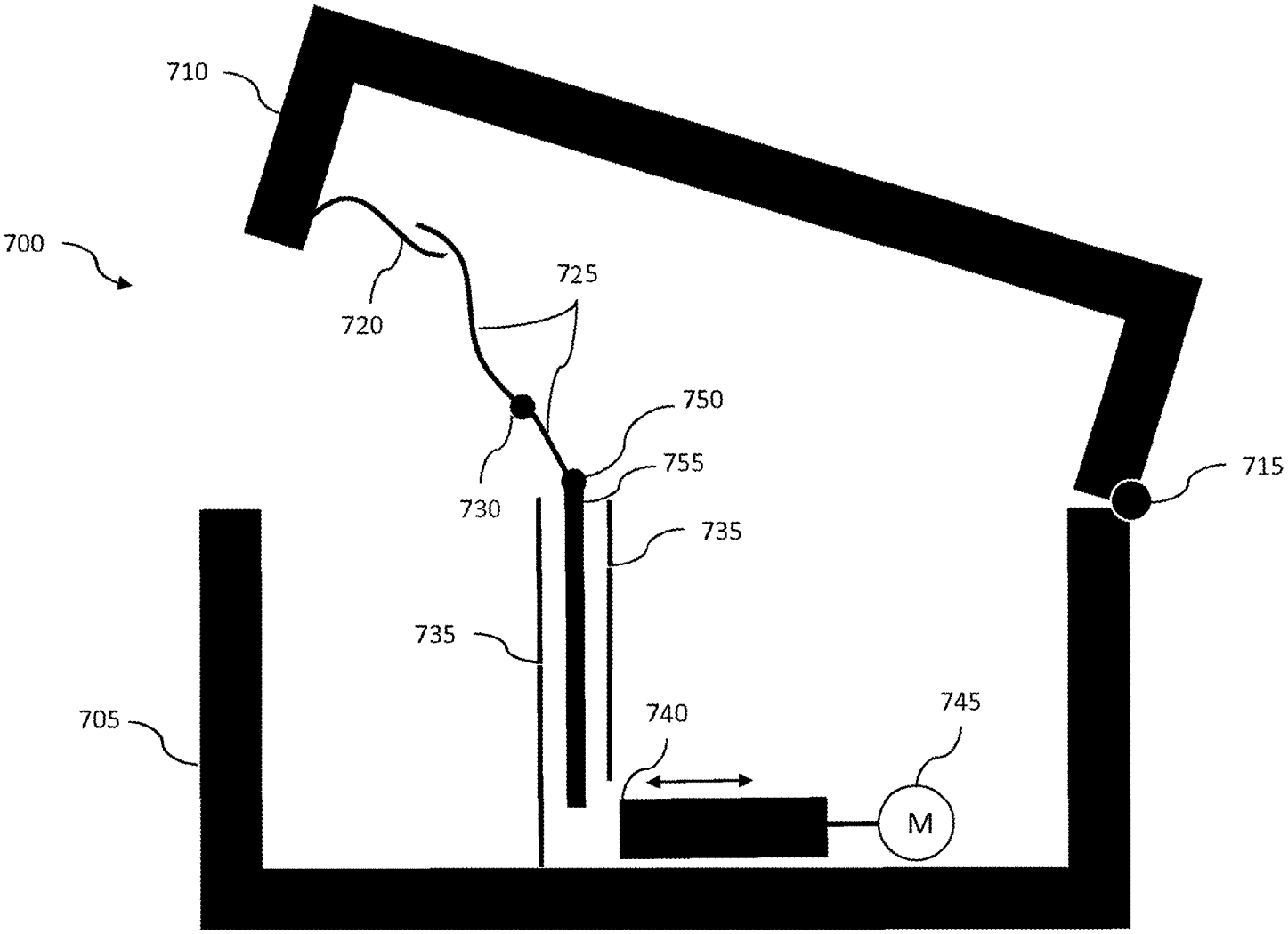

FIGS. 7A and 7B illustrate a locking mechanism of a lockbox in accordance with an illustrative embodiment. In alternative embodiments, additional, fewer, and/or different elements may be used. Additionally, FIGS. 7A and 7B are meant to be illustrative of the mechanical workings of a locking mechanism and are not meant to be limiting with respect to the size, orientation, etc. of the various elements. For example, in alternative embodiments, such a mechanism can have different proportions and/or shapes for various elements. As shown in FIGS. 7A and 7B, an illustrative lockbox 700 includes a base 705, a lid 710, a lid hinge 715, a lid arm 720, a locking arm 725, a locking arm pivot 730, a guide 735, a locking pin 740, a motor 745, a locking arm hinge 750, and a plunger 755.

FIG. 7A illustrates the lockbox 700 with the lid 710 closed, and FIG. 7B illustrates the lockbox 700 with the lid 710 partially opened. The base 705 can be the bottom portion of the lockbox 700 that is configured to hold the valuables stored in the lockbox 705. Although not illustrated, the base 705 can include a false bottom and/or other features to hide one or more of the components of the lockbox 705, including electronics, antennae, batteries, etc. The lid 710 and the base 705 can be connected to one another via the lid hinge 715. The lid hinge 715 can allow the lid 710 and the base 705 to open in a clam-shell manner. Fixed to the lid 710 is a lid arm 720. As shown in FIGS. 7A and 7B, the lid arm 720 does not move with respect to the lid 710.

As shown in FIG. 7A, when in a closed position, the locking arm 725 is located between the lid arm 720 and the top of the lid 710. The locking arm 725 pivots about the locking arm pivot 730, which is located between the ends of the locking arm 725. The locking arm 725 is connected to the plunger 755 via the locking arm hinge 750. The locking arm hinge 750 connects in a vertical direction the plunger 755 with the locking arm hinge 750, while allowing the angle formed between the locking arm 735 and the plunger 755 to change. That is, as the locking arm 725 pivots about the locking arm pivot 730, the plunger 755 can move in the vertical direction, accordingly. The locking arm pivot 730 can be stationary with respect to the base 705, although the locking arm pivot 730 may rotate along with the locking arm 725.

The plunger 755 can move vertically within the guide 735. For example, the plunger 755 can include a rod that slides along a tube of the guide 735. A locking pin 740 can be configured to slide underneath the plunger 755 and out of the way of the plunger 755, as illustrated by the arrows in FIGS. 7A and 7B. FIG. 7A illustrates the lockbox 700 and the locking pin 740 in a locked position. That is, the locking pin 740 is located beneath the plunger 755 such that the plunger 755 cannot move downward. Thus, if the lid 710 is pulled upward to open the lid 710, the lid arm 720 would hit the locking arm 725, which cannot pivot about locking arm pivot 730 because the plunger 755 cannot move downward. Accordingly, when the locking pin 740 is moved out of the way of the plunger 755 (e.g., to the right, as illustrated in FIG. 7B), the plunger 755 is free to move downward and, therefore, the locking arm 725 is free to pivot about the locking arm pivot 730. Thus, as shown in FIG. 7B, when the lid 710 is opened (partially), the lid arm 720 forces the locking arm 725 to pivot about the locking arm pivot 730, thereby forcing the plunger 755 downward. Although not shown in FIG. 7B, as the lid 710 is opened farther, the plunger 755 will be forced farther downward.

Similarly, when the lid 710 is being closed, the top of the lid 710 (or any other suitable portion of the lid 710) can contact the locking arm 725, thereby forcing the locking arm 725 to pivot and pull the plunger 755 up (back to the state as illustrated in FIG. 7A). When the lid 710 is closed, the plunger 755 will be out of the way of the locking pin 740, allowing the locking pin 740 to move underneath the plunger 755 to lock the lockbox 700. The locking pin 740 can be slid underneath and out of the way of the plunger 755 via a motor 745. The motor 745 can be any suitable actuating device, such as a servo motor.

The operations described in this specification can be implemented as operations performed by a data processing apparatus on data stored on one or more computer-readable storage devices or received from other sources. The term "data processing apparatus" or "computing device" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and an I/O device, e.g., a mouse or a touch sensitive screen, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. In some cases, the actions recited herein can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method for tracking an item comprising:

determining, by a server, an inventory of tags in communication with a gateway using a first wireless communication mode;

enabling, in response to a first triggering event recognized by a tag, a second wireless communication mode;

communicating to a mobile device in communication with the server, by the tag recognizing the first triggering event via the second wireless communication mode, identification information of the tag updating, by the server, the inventory of tags to indicate that the tag is in communication with the mobile device if a response is received from the mobile device;

enabling, in response to a second triggering event recognized by the tag, a third wireless communication mode and a location detection capability of the tag;

determining, by the tag, a geographic location of the tag using the location detection capability; and transmitting, using the third wireless communication mode, to a server the geographic location of the tag.

2. The method of claim 1, wherein the first triggering event includes the tag determining that the gateway is not within communication range of the tag.

3. The method of claim 2, wherein said determining that the gateway is not within communication range of the tag comprises determining that no associated gateway is within communication range of the tag, and wherein a plurality of associated gateways were associated with the tag.

4. The method of claim 2, further comprising:

disabling, in response to the tag determining that the gateway is not within communication range of the tag, the first wireless communication mode.

5. The method of claim 1, wherein the second triggering event includes the tag determining that the mobile device is not within communication range of the tag.

6. The method of claim 5, wherein said determining that the mobile device is not within communication range of the tag comprises determining that no associated mobile device is within communication range of the tag, and wherein a plurality of associated mobile devices were associated with the tag.

7. The method of claim 1, wherein one of the first triggering event and the second triggering event includes receiving an indication from a sensor.

8. The method of claim 7, wherein the sensor is an accelerometer, a temperature probe, a humidity probe, or a pressure sensor.

9. The method of claim 1, further comprising:

determining, by the tag, a battery power level of the tag; and transmitting, using the third wireless communication mode, the battery power level to the server.

10. The method of claim 1, wherein the first wireless communication mode comprises communicating via a wireless local area network, wherein the second wireless communication mode comprises communicating via a short-range wireless connection, and wherein the third wireless communication mode comprises communicating via a cellular network.

11. The method of claim 1, wherein the location detection capability comprises a capability to determine the location of the tag via a global positioning system.

12. The method of claim 1, wherein the location detection capability comprises a capability to determine the location of the tag via triangulation of a plurality of cellular network towers.

13. The method of claim 1, further comprising:

transmitting, using the third wireless communication mode, the geographic location to the server at a first predetermined interval when the tag is moving and at a second predetermined interval different from the first predetermined interval when the tag is stationary.

14. The method of claim 1, further comprising determining, by the tag, that the tag is moving using an accelerometer, wherein said transmitting the geographic location of the tag is in response to said determining that the tag is moving.

15. The method of claim 1, further comprising:

receiving, at the tag, a query signal from the gateway; and in response to receiving the query signal, transmitting, by the tag, tag identification information to the gateway.

16. The method of claim 15, further comprising:

storing, in memory of the tag, a list of associated gateways; and determining that the gateway is in the list of associated gateways.

17. The method of claim 15, wherein receiving the query signal comprises receiving an access code, and wherein the method further comprises determining that the access code indicates that the gateway is an associated gateway.

18. A system for tracking an item comprising:

a server; and a device, comprising:

memory configured to store a list of associated gateways and a list of associated mobile devices;

a first wireless transceiver configured to communicate using a first wireless communication mode;

a second wireless transceiver configured to communicate using a second wireless communication mode;

a third wireless transceiver configured to communicate using a third wireless communication mode;

a location detector configured to determine a geographic location of the device; and a processor operatively coupled to the memory, the first wireless transceiver, the second wireless transceiver, the third wireless transceiver, and the location detector, wherein the processor is configured to:

receive a first sweep request from a gateway in the list of associated gateways;

communicate a first response to the first sweep request via the first wireless transceiver to the gateway;

enable, in response to the processor recognizing a first triggering event, the second wireless transceiver;

receive at the device, via the second wireless transceiver, a second sweep request from a mobile device in the list of associated mobile devices;

communicate a second response to the second sweep request to the mobile device via the second wireless transceiver, the response including identification information of the tag;

enable, in response to the processor recognizing a second triggering event, the third wireless transceiver and the location detector;

receive, from the location detector, the geographic location of the device; and transmit, using the third wireless transceiver, to a server the geographic location of the device;

wherein the server is configured to update an inventory of tags in communication with the associated gateways and the associated mobile devices based on the first response to the first sweep request and the second response to the second sweep request.

19. The system of claim 18, wherein the first triggering event includes the processor determining that the gateway is not within communication range of the device.

20. The system of claim 19, wherein the second triggering event includes the processor determining that the mobile device is not within communication range of the device.

21. The system of claim 20, wherein the processor is further configured to:

disable, in response to the processor determining that the gateway is not within communication range of the device, the first wireless transceiver; and disable, in response to the processor determining that the mobile device is not within communication range of the device, the second wireless transceiver.

22. The system of claim 18, wherein one of the first triggering event and the second triggering event includes receiving an indication from a sensor.

23. The method of claim 22, wherein the sensor is an accelerometer, a temperature probe, a humidity probe, or a pressure sensor.

24. The system of claim 18, wherein the processor is further configured to:

determine that no gateway listed in the list of associated gateways is within communication range of the device using the first wireless transceiver; and determine that no mobile device listed in the list of associated mobile devices is within communication range of the device using the second wireless transceiver.

25. The system of claim 18, further comprising an accelerometer configured to determine movement of the device, wherein the processor is further configured to receive, from the accelerometer, an indication that the device is in motion, and wherein transmission of the geographic location to the server is performed in response to the indication that the device is in motion.

26. A non-transitory computer-readable medium having computer-readable instructions stored thereon that, upon execution by a processor, cause a device configured to communicate using a first wireless communication mode to perform operations, wherein the instructions comprise:

instructions to enable, in response to the device recognizing a first triggering event, a second wireless communication mode;

instructions to communicate information to a mobile device in response to recognizing that the device can communicate with the mobile device, by the device requesting a response from the mobile device via the second wireless communication mode, the information to enable a server to update an inventory of devices in communication with the gateway and the mobile device;

instructions to enable, in response to the device recognizing a second triggering event, a third wireless communication mode and a location detection capability of the device;

instructions to determine a geographic location of the device using the location detection capability; and instructions to transmit, using the third wireless communication mode, to a server the geographic location of the device.

27. The non-transitory computer-readable medium of claim 26, wherein the first triggering event includes the device determining that the gateway is not within communication range of the device.

28. The non-transitory computer-readable medium of claim 27, wherein the second triggering event includes the device determining that the mobile device is not within communication range of the device.

29. The non-transitory computer-readable medium of claim 28, wherein the instructions further comprise:

instructions to disable, in response to the device determining that the gateway is not within communication range of the device, the first wireless communication mode; and instructions to disable, in response to the device determining that the mobile device is not within communication range of the device, the second wireless communication mode.

30. The non-transitory computer-readable medium of claim 26, wherein one of the first triggering event and the second triggering event includes receiving an indication from a sensor.

31. The non-transitory computer-readable medium of claim 26, wherein the sensor is an accelerometer, a temperature probe, a humidity probe, or a pressure sensor.

32. The non-transitory computer-readable medium of claim 26, wherein the instructions further comprise instructions to determine that the device is moving using an accelerometer, and wherein the instructions to transmit the geographic location of the device comprise instructions to transmit the geographic location of the device in response to the device determining that the device is moving.

* * * * *